US007417543B2

(12) United States Patent
Bergman et al.

(10) Patent No.: US 7,417,543 B2
(45) Date of Patent: Aug. 26, 2008

(54) METHOD AND SYSTEM FOR MONITORING CONTAINERS TO MAINTAIN THE SECURITY THEREOF

(75) Inventors: Johan Bergman, Bromma (SE); Eric Sandberg, Knivsta (SE); Martin Voigt, Iserlohn (DE)

(73) Assignee: CommerceGuard AB, Bromma (DE)

( * ) Notice: Subject to any disclaimer, the term of this patent is extended or adjusted under 35 U.S.C. 154(b) by 217 days.

(21) Appl. No.: 10/989,016

(22) Filed: Nov. 15, 2004

(65) Prior Publication Data

US 2005/0179545 A1 Aug. 18, 2005

Related U.S. Application Data

(60) Provisional application No. 60/520,120, filed on Nov. 13, 2003.

(51) Int. Cl.

| | |
|---|---|
| ***G08B 1/08*** | (2006.01) |
| ***G08B 13/08*** | (2006.01) |
| ***G08B 21/00*** | (2006.01) |
| ***H01H 1/66*** | (2006.01) |
| ***H01H 7/16*** | (2006.01) |
| ***H01H 9/00*** | (2006.01) |

(52) U.S. Cl. ..... 340/545.6; 340/539.1; 340/539.13; 340/539.22; 340/539.23; 340/545.1; 340/545.2; 340/547; 340/548; 340/686.1; 340/686.2; 340/686.6; 335/151; 335/152; 335/153; 335/154; 335/155; 335/205; 335/206; 335/207

(58) Field of Classification Search ..... 340/545.1, 340/545.2–545.8, 547, 550–552, 539.1, 539.16, 340/539.13, 539.22, 539.23, 548, 686.1, 340/686.2, 686.6; 335/151–154, 205–207
See application file for complete search history.

(56) References Cited

U.S. PATENT DOCUMENTS 4,688,244 A 8/1987 Hannon et al.

(Continued)

FOREIGN PATENT DOCUMENTS

BE 1012912 5/2001

(Continued)

OTHER PUBLICATIONS

Jenn Hann Technology Co., Ltd.; Polices and People On-line Computer System; Magnetic Spring Projector. (with English translation).

(Continued)

*Primary Examiner*—George A Bugg
*Assistant Examiner*—Lam P Pham
(74) *Attorney, Agent, or Firm*—Global Patent Operation

(57) ABSTRACT

A method and system for monitoring the integrity of a container specifically adapted for the system and constructed with at least one door. A sensor is secured in the container for detecting proximity of the at least one door relative to another area of the container and for providing sensor data that may be communicated from the container relative to its integrity.

24 Claims, 16 Drawing Sheets

U.S. PATENT DOCUMENTS

| | | | | |
|---|---|---|---|---|
| 4,750,197 | A * | 6/1988 | Denekamp et al. | 455/404.2 |
| 4,849,927 | A | 7/1989 | Vos | |
| 4,897,642 | A | 1/1990 | DiLullo et al. | |
| 5,097,253 | A | 3/1992 | Eschbach et al. | |
| 5,189,396 | A | 2/1993 | Stobbe | |
| 5,347,274 | A | 9/1994 | Hassett | |
| 5,355,511 | A | 10/1994 | Hatano et al. | |
| 5,448,220 | A | 9/1995 | Levy | |
| 5,475,597 | A | 12/1995 | Buck | |
| 5,565,858 | A | 10/1996 | Guthrie | |
| 5,602,526 | A | 2/1997 | Read | |
| 5,686,888 | A | 11/1997 | Welles, II et al. | |
| 5,712,789 | A | 1/1998 | Radican | |
| 5,828,322 | A | 10/1998 | Eberhard | |
| 5,831,519 | A | 11/1998 | Pedersen et al. | |
| 5,912,619 | A * | 6/1999 | Vogt | 340/545.1 |
| 5,959,568 | A | 9/1999 | Woolley | |
| 6,069,563 | A | 5/2000 | Kadner et al. | |
| 6,211,907 | B1 | 4/2001 | Scaman et al. | |
| 6,266,008 | B1 | 7/2001 | Huston et al. | |
| 6,400,266 | B1 | 6/2002 | Brown, Jr. | |
| 6,437,702 | B1 | 8/2002 | Ragland et al. | |
| 6,483,434 | B1 | 11/2002 | UmiKer | |
| 6,577,921 | B1 | 6/2003 | Carson | |
| 6,665,585 | B2 | 12/2003 | Kawase | |
| 6,687,609 | B2 | 2/2004 | Hsiao et al. | |
| 6,737,969 | B2 * | 5/2004 | Carlson et al. | 340/547 |
| 6,745,027 | B2 | 6/2004 | Twitchell, Jr. | |
| 6,747,558 | B1 | 6/2004 | Thorne et al. | |
| 6,753,775 | B2 | 6/2004 | Auerbach et al. | |
| 6,952,165 | B2 * | 10/2005 | Kovach et al. | 340/545.1 |
| 7,019,640 | B2 * | 3/2006 | Canich et al. | 340/531 |
| 7,081,816 | B2 * | 7/2006 | Schebel et al. | 340/545.6 |
| 7,098,784 | B2 * | 8/2006 | Easley et al. | 340/539.13 |
| 2001/0030599 | A1 | 10/2001 | Zimmerman et al. | |
| 2004/0041705 | A1 | 3/2004 | Auerbach et al. | |
| 2004/0066328 | A1 | 4/2004 | Galley et al. | |
| 2004/0073808 | A1 | 4/2004 | Smith et al. | |
| 2004/0100379 | A1 | 5/2004 | Boman et al. | |
| 2004/0113783 | A1 | 6/2004 | Yagesh | |
| 2004/0189466 | A1 | 9/2004 | Morales | |
| 2004/0196152 | A1 * | 10/2004 | Tice | 340/539.26 |
| 2004/0215532 | A1 | 10/2004 | Boman et al. | |
| 2004/0227630 | A1 | 11/2004 | Shannon et al. | |
| 2004/0233041 | A1 | 11/2004 | Bohman et al. | |
| 2005/0046567 | A1 | 3/2005 | Mortenson et al. | |
| 2005/0073406 | A1 | 4/2005 | Easley et al. | |
| 2005/0110635 | A1 | 5/2005 | Giermanski et al. | |
| 2005/0134457 | A1 * | 6/2005 | Rajapakse et al. | 340/545.6 |
| 2005/0154527 | A1 | 7/2005 | Ulrich | |

FOREIGN PATENT DOCUMENTS

| | | | |
|---|---|---|---|
| DE | 195 04 733 | A1 | 8/1996 |
| DE | 195 34 948 | | 3/1997 |
| DE | 197 04 210 | | 8/1998 |
| EP | 0 649 957 | A2 | 4/1995 |
| EP | 0 704 712 | A1 | 4/1996 |
| EP | 0 748 083 | A1 | 12/1996 |
| EP | 1063627 | | 12/2000 |
| EP | 1 182 154 | | 2/2002 |
| EP | 1 246 094 | | 10/2002 |
| GB | 1 055 457 | | 1/1967 |
| GB | 2 254 506 | A | 10/1992 |
| JP | 11246048 | | 9/1999 |
| JP | 2001261159 | | 9/2001 |
| JP | 2002039659 | | 2/2002 |
| RU | 2177647 | | 12/2001 |
| WO | WO 99/33040 | | 7/1999 |
| WO | WO 99/38136 | | 7/1999 |
| WO | WO 00/70579 | | 11/2000 |
| WO | WO 01/33247 | A1 | 5/2001 |
| WO | WO 02/25038 | A2 | 3/2002 |
| WO | WO 02/077882 | | 10/2002 |
| WO | WO-02/089084 | | 11/2002 |
| WO | WO 03/023439 | | 3/2003 |
| WO | WO-2004/009473 | | 1/2004 |
| WO | WO-2004/066236 | | 8/2004 |
| WO | WO-2005/008609 | | 1/2005 |

OTHER PUBLICATIONS

Bluetooth—The Universal Radio Interface for Ad Hoc, Wireless Connectivity; JAAP HAARTSEN, 40 pages.

"A Software System for Locating Mobile Users: Design, Evaluation, and Lessons"; Bahl et al.; No Date; p. 1-13.

"Radar: An In-Building RF-based User Location and Tracking System"; Bahl et al.; No Date; 10 pages.

U.S. Appl. No. 11/198,738, Boman et al.

Dallas Semiconductor Maxim, "iButton Overview", XP-002340628, Aug. 10, 2003, (3 pgs.)

Honeywell, "Chapter 2, Hall Effect Sensors", Micro Switch Sensing and Control, pp. 3-8.

* cited by examiner

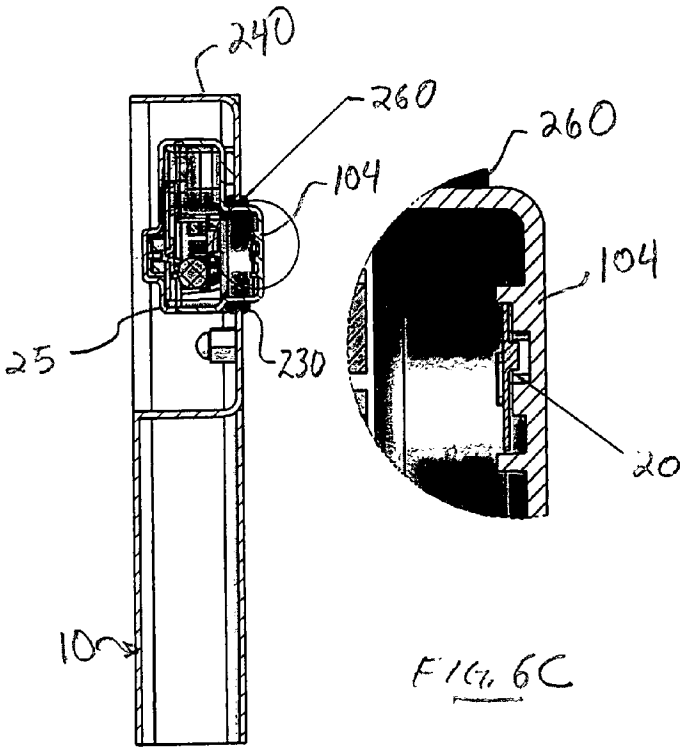
FIG. 6C
FIG. 6B
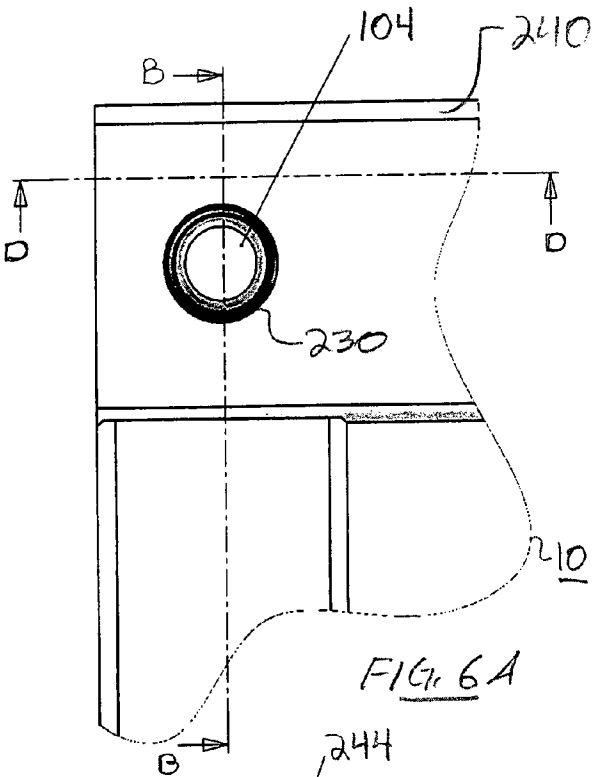
FIG. 6A
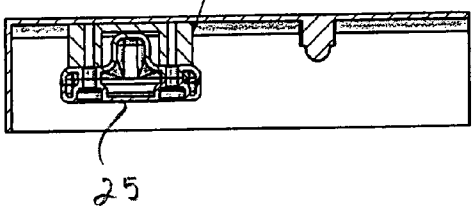
FIG. 6D

METHOD AND SYSTEM FOR MONITORING CONTAINERS TO MAINTAIN THE SECURITY THEREOF

CROSS-REFERENCES TO RELATED APPLICATIONS

This Application for Patent claims priority from, and hereby incorporates by reference for any purpose, the entire disclosure of U.S. Provisional Patent Application No. 60/520,120 filed on Nov. 13, 2003. This Application for Patent also incorporates by reference for any purpose, the entire disclosure of co-pending U.S. patent application Ser. No. 10/667,282 filed on Sept. 17, 2003 and co-pending U.S. patent application Ser. No. 10/847,185 filed on May 17, 2004.

BACKGROUND

1. Technical Field

The present invention relates to a method of and system for monitoring the security of a container and tracking its location and, more particularly, but not by way of limitation, to a method of and system for monitoring the integrity of and tracking intermodal freight containers throughout a supply chain to discourage or prevent such urgent problems as terrorism, and also illegal immigration, theft or adulteration of goods, and other irregularities.

2. History of Related Art

The vast majority of goods shipped throughout the world are shipped via what are referred to as intermodal freight containers. As used herein, the term "containers" includes any container (whether with wheels attached or not) that is not generally transparent to radio frequency signals, including, but not limited to, intermodal freight containers. However, it is contemplated that containers may, in the future, be partially constructed with polycarbonates or other advanced non-metallic materials which may be RF transparent. The most common intermodal freight containers are known as International Standards Organization (ISO) dry intermodal containers, meaning they meet certain specific dimensional, mechanical and other standards issued by the ISO to facilitate global trade by encouraging development and use of compatible standardized containers, handling equipment, ocean-going vessels, railroad equipment and over-the-road equipment throughout the world for all modes of surface transportation of goods. There are currently more than 19 million such containers in active circulation around the world as well as many more specialized containers such as refrigerated containers that carry perishable commodities. The United States alone receives approximately eight million loaded containers per year, or approximately 20,000 per day, representing nearly half of the total value of all goods received each year.

Since approximately 90% of all goods shipped internationally are moved in containers, container transport has become the backbone of the world economy. The sheer volume of containers transported worldwide renders individual physical inspection impracticable, and only approximately 2-4% of containers entering the United States are actually physically inspected. Risk of introduction of a terrorist biological, radiological or explosive device via a freight container is high, and the consequences to the international economy of such an event could be catastrophic, given the importance of containers in world commerce.

Even if sufficient resources were devoted in an effort to conduct physical inspections of all containers, such an undertaking would result in serious economic consequences. The time delay alone could, for example, cause the shut down of factories and undesirable and expensive delays in shipments of goods to customers.

Current container designs fail to provide adequate mechanisms for establishing and monitoring the security of the containers or their contents. A typical container includes one or more door hasp mechanisms that allow for the insertion of a plastic or metal indicative "seal" or bolt barrier conventional "seal" to secure the doors of the container. The door hasp mechanisms that are conventionally used are very easy to defeat, for example, by drilling an attachment bolt of the hasp out of a door to which the hasp is attached. The conventional seals themselves currently in use are also quite simple to defeat by use of a common cutting tool and replacement with a rather easily duplicated seal.

A more advanced solution proposed in recent time is an electronic seal ("e-seal"). These e-seals are equivalent to traditional door seals and are applied to the containers via the same, albeit weak, door hasp mechanism as an accessory to the container, but include an electronic device such as a radio or radio reflective device that can transmit the e-seal's serial number and a signal if the e-seal is cut or broken after it is installed. However, the e-seal is not able to communicate with the interior or contents of the container and does not transmit information related to the interior or contents of the container to another device. Since e-seals are accessory to, and not a permanent part of, the container, their overall usefulness can be easily eliminated when, for example, the e-seal is simply cut and discarded. In that event, all data is lost.

The e-seals typically employ either low power radio transceivers or use radio frequency backscatter techniques to convey information from an e-seal tag to a reader installed at, for example, a terminal gate. Radio frequency backscatter involves use of a relatively expensive, narrow band high-power radio technology based on combined radar and radio-broadcast technology. Radio backscatter technologies require that a reader send a radio signal with relatively high transmitter power (i.e., 0.5-3 W) that is reflected or scattered back to the reader with modulated or encoded data from the e-seal.

In addition, e-seal applications currently use completely open, unencrypted and insecure air interfaces and protocols allowing for relatively easy hacking and counterfeiting of e-seals. Current e-seals also operate only on locally authorized frequency bands below 1 GHz, rendering them impractical to implement in global commerce involving intermodal containers since national radio regulations around the world currently do not allow their use in many countries.

Furthermore, the e-seals are not effective at monitoring security of the containers from the standpoint of alternative forms of intrusion or concern about the contents of a container, since a container may be breached or pose a hazard in a variety of ways since the only conventional means of accessing the inside of the container is through the doors of the container. For example, a biological agent could be implanted in the container through the container's standard air vents, or the side walls of the container could be cut through to provide access. Although conventional seals and the e-seals afford one form of security monitoring the door of the container, both are susceptible to damage. The conventional seal and e-seals typically merely hang on the door hasp of the container, where they are exposed to physical damage during container handling such as ship loading and unloading. Moreover, conventional seals and e-seals cannot monitor the contents of the container.

The utilization of multiple sensors for monitoring the interior of a container could be necessary to cover the myriad of possible problems and/or threatening conditions. For example, the container could be used to ship dangerous, radio-active materials, such as a bomb and/or components of a bomb. In that scenario, a radiation sensor or explosive sensor would be needed in order to detect the presence of such a serious threat. Unfortunately, terrorist menaces are not limited to a single category of threat. Both chemical and biological warfare have been used and pose serious threats to the public at large. For this reason, both types of detectors could be necessary, and in certain situations, radiation, gas and biological sensors could be deemed appropriate. One problem with the utilization of such sensors is, however, the transmission of such sensed data to the outside world when the sensors are placed in the interior of the container. Since standard intermodal containers are manufactured from steel that is opaque to radio signals, it is virtually impossible to have a reliable system for transmitting data from sensors placed entirely within such a container unless the data transmission is addressed. If data can be effectively transmitted from sensors disposed entirely within an intermodal container, conditions such as temperature, light, combustible gas, motion, radio activity, biological and other conditions and/or safety parameters can be monitored. These aspects are more fully set forth, shown and described in co-pending U.S. patent application Ser. No. 10/847,185 filed May 17, 2004 and incorporated herein by referenced. Moreover, the integrity of the mounting of such sensors are critical and require a more sophisticated monitoring system than the aforementioned door hasp mechanisms that allow for the insertion of an external plastic or metal indicative "seal" or bolt barrier conventional "seal" to secure the doors of the container.

In addition to the above, the monitoring of the integrity of containers via door movement can be relatively complex. Although the containers are constructed to be structurally sound and carry heavy loads, both within the individual containers as well as by virtue of containers stacked upon one another, each container is also designed to accommodate transverse loading to accommodate dynamic stresses and movement inherent in (especially) ocean transportation and which are typically encountered during shipment of the container. Current ISO standards for a typical container may allow movement between the door panels on a vertical axis due to transversal loads by as much as 40 millimeters relative to one another. Heretofore, security approaches based upon maintaining a tight interrelationship between the physical interface between two container doors were generally not practicable. Structural stresses on the container from other containers stacked above it, as well as shipping motion and the like, will cause twisting of the container and relative vertical movement between the container doors. This is called "racking." The relative vertical movement will, however, generally not translate into appreciable horizontal separation between the doors.

It would therefore be advantageous to provide a method of and system for: (i) monitoring the movement of the doors of a container relative to another area of the container in a cost effective, always available, yet reliable fashion; (ii) providing for a data path for other security sensors placed in a container to detect alternative means of intrusion or potential presence of dangerous or illicit cargo to receivers in the outside world; and (iii) simultaneously provide a means for tracking transport movements of containers for reasons of security and logistics efficiency.

SUMMARY OF THE INVENTION

The present invention relates to a method of and system for efficiently and reliably monitoring the integrity of a container to maintain the security thereof. More particularly, one aspect of the invention includes a sensor system for monitoring the integrity of a container having at least one door, the system comprising a sensor housing secured in the container in a position to monitor the position of the at least one door, and a sensor secured in the housing for detecting proximity of the at least one door relative to another area of the container and providing sensor data. A data interpretation device is disposed inside the container in communication with the sensor for interpreting the sensor data and a transmitter is provided for communicating information relative to the sensed proximity to a location outside the container.

In another aspect, an embodiment of the above described the sensor housing is secured in the at least one door of the container. In one embodiment, the sensor housing is integrally mounted in the at least one door of the container.

In a further aspect, an embodiment of the above described system includes the container having a second door adjacent the at least one door, the sensor housing being secured in the at least one door, and the sensor secured in the housing being adapted for detecting proximity of the at least one door relative to the second door for providing the sensor data.

In yet a further aspect, an embodiment of the above described system includes the container being non-FR transparent and being constructed with an aperture adapted for receipt of a portion of the sensor housing for exposure outwardly of the container in the mounting thereof for sending and receiving radio frequency signals. The transmitter of the system is secured in the housing in position for communicating an alarm, warning and/or other information relative to the sensed proximity via the aperture to a location outside the container. The sensor housing may, in this embodiment, include a gasket extending there around for sealed engagement of the housing relative to the aperture. Further embodiments of the above described system include the sensor comprising a reed switch, a Hall effect sensor, or another type of proximity sensor. In a preferred embodiment, a Hall effect sensor incorporating a ring magnet is utilized.

Yet a further embodiment of the invention includes the sensor housing being secured in the at least one door of the container, the at least one door of the container including an aperture formed therein and adapted for receipt of a portion of the housing therethrough, the data interpretation device being disposed within the housing, and the transmitter being disposed within the housing and positioned for communicating information to a location outside the container via the aperture formed therein.

Moreover, another embodiment of the invention includes the container having a sensor plate, the sensor comprising a Hall effect sensor, the sensor housing being secured in the at least one door, and the Hall effect sensor and the sensor plate being mounted within the container for functional interaction one with the other to monitor the position of the at least one door.

In another aspect, an embodiment of the present invention includes a method of manufacturing a container of the type bearing at least one door for being capable of monitoring for a breach in the integrity thereof. The method comprises providing a sensor system with a sensor, sensor housing, data interpretation device and transmitter and structurally monitoring the sensor housing in the container in a position to monitor the position of the at the least one door. The sensor is secured in the housing for detecting proximity of the at least one door relative to another area of the container for providing sensor data, and a data interpretation device is disposed inside the container in communication with the sensor for interpreting the sensor data. Finally, a transmitter is provided in the container for communicating information relative to the sensed proximity to a location outside the container.

In another embodiment, the method further includes the use of a Hall effect sensor and the proximity detection includes the step of measuring a Hall effect between the at least one door and another area of the container. In one embodiment, the Hall effect sensor incorporates a ring magnet.

In a further embodiment, the method includes securing the sensor housing in the at least one door of the container, forming an aperture in the least one door of the container in position for receipt of a portion of the housing therethrough, securing the data interpretation device within the housing, and securing the transmitter within the housing in position for communicating information to a location outside the container via the aperture formed therein.

In yet a further embodiment, the method includes using a Hall effect sensor and securing housing in the at least one door, and securing a sensor plate within the container so that the Hall effect sensor and sensor plate functionally interact one with the other to monitor the position of the at least one door.

It has been found that a container security device of the type set forth, shown, and described below, may be mounted in and or integrally constructed with a container for effective monitoring of the integrity and condition thereof and its contents. As will be defined in more detail below, a device in accordance with principles of the present invention is constructed for positioning within a pre-defined portion of the container, such as a container door, to monitor the position of the door.

BRIEF DESCRIPTION OF DRAWINGS

A more complete understanding of exemplary embodiments of the present invention can be achieved by reference to the following Detailed Description of Exemplary Embodiments of the Invention when taken in conjunction with the accompanying Drawings, wherein:

FIG. 2C is an enlarged perspective view of a region of the device of FIG. 2B illustrating one aspect of the construction thereof;

FIG. 2D is a perspective view of the device of FIG. 2B taken from the opposite side thereof;

FIG. 2I is a side elevational cross-sectional view of the device of FIG. 2E taken along lines I-I thereof;

FIG. 6A is an enlarged front view of a portion of the container illustrated in FIGS. 4 and 5;

FIG. 6B is a side elevational cross-sectional view of the container section of FIG. 6A taken along the lines of B-B thereof;

FIG. 6C is an enlarged portion of the device of FIG. 2B shown mounted in the container section in FIG. 6B as designated therein;

FIG. 6D is a top plan cross-sectional view of the container section of FIG. 6A taken along lines D-D thereof;

DETAILED DESCRIPTION OF EXEMPLARY EMBODIMENTS OF THE PRESENT INVENTION

It has been found that a container security device of the type set forth, shown, and described below, may be constructed in and secured to a container for effective monitoring of the integrity and condition thereof and its contents. As will be defined in more detail below, a device in accordance with principles of the present invention is constructed for positioning within a pre-defined portion of the container.

Figure 1A:
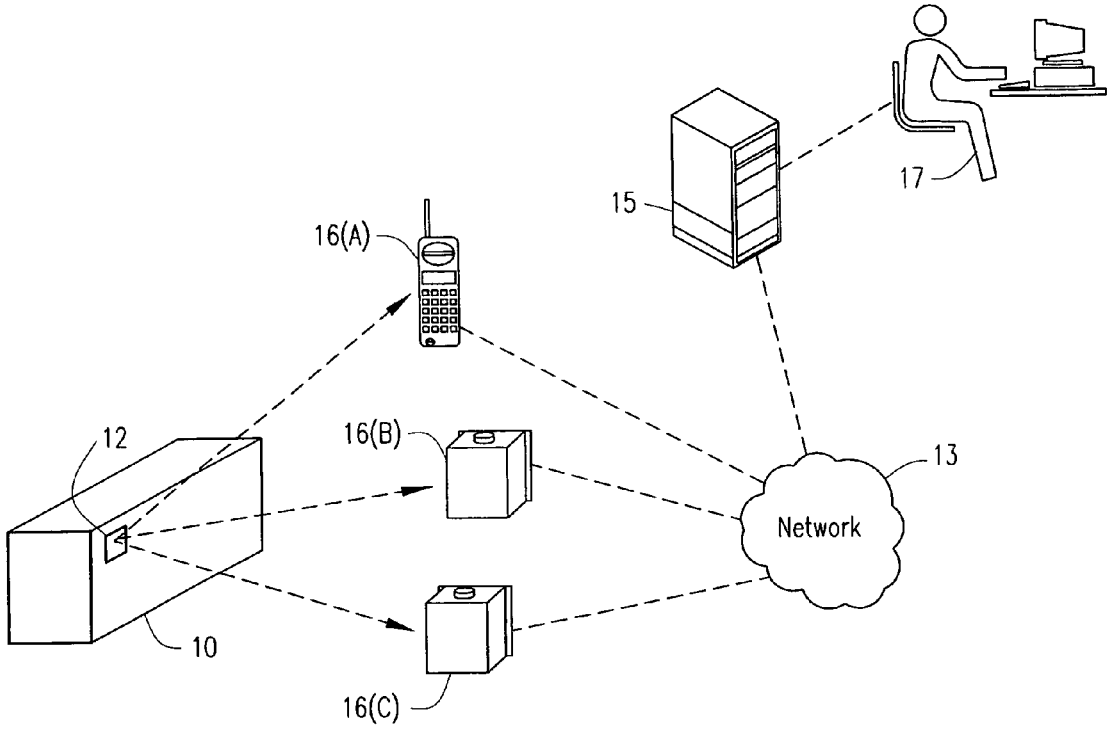
FIG. 1A is a diagram illustrating communication among components of a system according to an embodiment of the present invention.

FIG. 1A is a diagram illustrating communication among components of a system in accordance with principles of the present invention. The system includes a device 12, at least one variety of reader 16, a server 15, and a software backbone 17. The device 12 ensures that an undetected breach of the container 10 has not occurred after the container 10 has been secured. The container 10 is secured and tracked by a reader 16. Each reader 16 may include hardware or software for communicating with the server 15 such as a modem for transmitting data over, for example, GSM or CDMA networks, or over a cable for downloading data to a PC that transmits the data over the Internet to the server 15. Various conventional means for transmitting the data from the reader 16 to the server 15 may be implemented within the reader 16 or as a separate device. The reader 16 may be configured as a handheld reader 16(A), a mobile reader 16(B), or a fixed reader 16(C). The handheld reader 16(A) may be, for example, operated in conjunction with, for example, a mobile phone, a personal digital assistant, or a laptop computer. The mobile reader 16(B) is basically a fixed reader with a GPS interface, typically utilized in mobile installations (e.g., on trucks, trains, or ships using existing GPS, AIS or similar positioning systems) to secure, track, and determine the integrity of the container in a manner similar to that of the handheld reader 16(A). In fixed installations, such as, for example, those of a port or shipping yard, the fixed reader 16(C) is typically installed on a crane or gate. The reader 16 serves primarily as a relay station between the device 12 and the server 15.

The server 15 stores a record of security transaction details such as, for example, door events (e.g., security breaches, container security checks, arming and disarming the container), location, as well as any additional desired peripheral sensor information (e.g., temperature, motion, radioactivity). The server 15, in conjunction with the software backbone 17, may be accessible to authorized parties in order to determine a last known location of the container 10, make integrity inquiries for any number of containers, or perform other administrative activities.

The device 12 communicates with the readers 16 via a short-range radio interface such as, for example, a radio interface utilizing direct-sequence spread-spectrum principles. The radio interface may use, for example, BLUETOOTH or any other short-range, low-power radio system that operates in the license-free Industrial, Scientific, and Medical (ISM) band, which operates around e.g. 2.4 GHz. Depending on the needs of a specific solution, related radio ranges are provided, such as, for example, a radio range of up to 100 m.

The readers 16 may communicate via a network 13, e.g. using TCP/IP, with the server 15 via any suitable technology such as, for example, Universal Mobile Telecommunications System (UMTS), Global System for Mobile Communications (GSM), Code Division Multiple Access (CDMA), Time Division Multiple Access (TDMA), Pacific Digital Cellular System(PDC), Wideband Local Area Network (WLAN), Local Area Network (LAN), Satellite Communications systems, Automatic Identification Systems (AIS), or Mobitex. The server 15 may communicate with the software backbone 17 via any suitable wired or wireless technology. It should be noted that a key function of the system is to, upon a proper request from a reader, to issue encrypted arming keys, as more specifically set forth, shown and described in the above-referenced co-pending U.S. patent application Ser. No. 10/667,282 incorporated herein by reference. The software backbone 17 is adapted to support real-time surveillance services such as, for example, tracking and arming of the container 10 via the server 15, the readers 16, and the device 12. The server 15 and/or the software backbone 17 are adapted to store information such as, for example, identification information, tracking information, door events, and other data transmitted by the device 12 and by any additional peripheral sensors interoperably connected to the device 12. The software backbone 17 also allows access for authorized parties to the stored information via a user interface that may be accessed via, for example, the Internet.

Figure 1B:
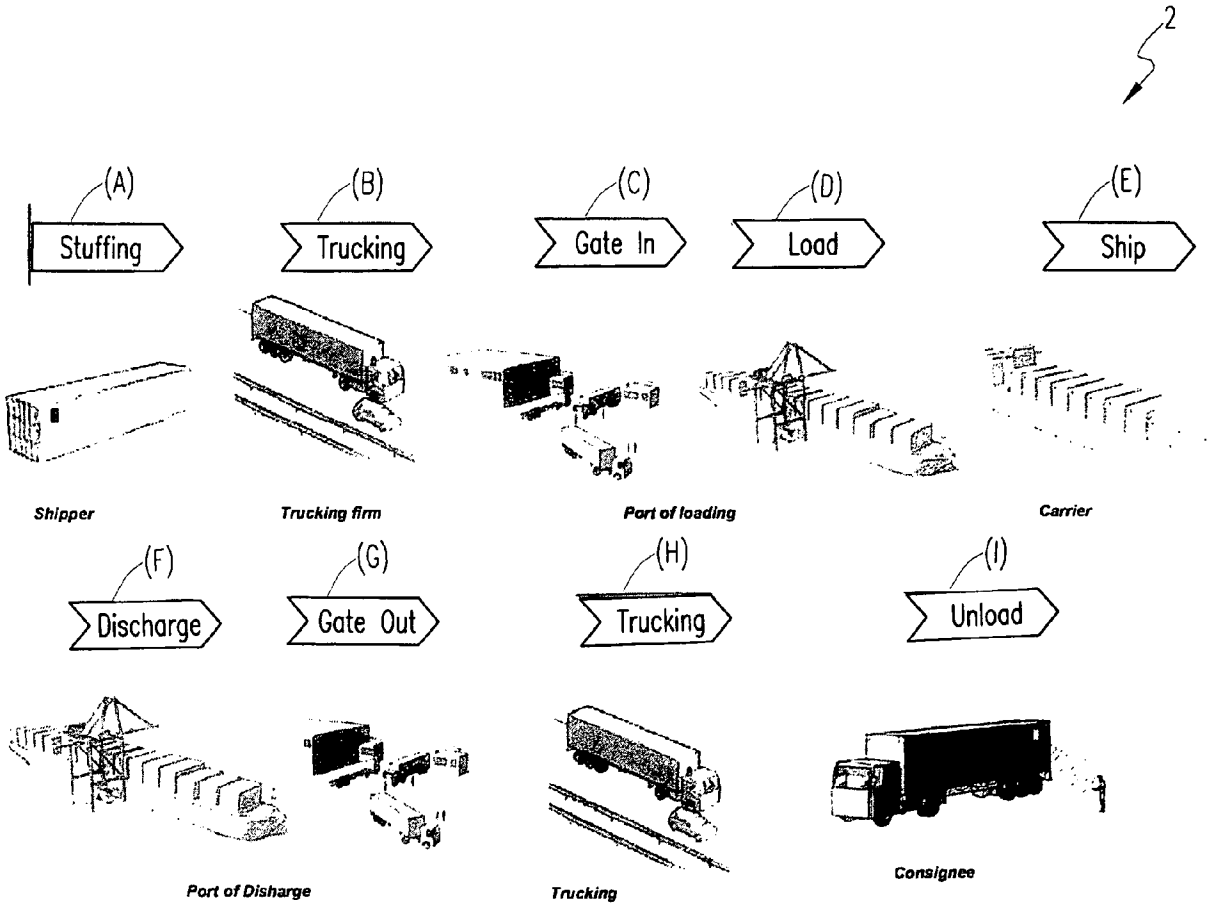
FIG. 1B is a diagram illustrating an exemplary supply chain.

Referring now to FIG. 1B, there is shown a diagram illustrating a flow 2 of an exemplary supply chain from points (A) to (I). Referring first to point (A), a container 10 is filled with cargo by a shipper or the like. At point (B), the loaded container is shipped to a port of embarkation via highway or rail transportation. At point (C), the container is gated in at the port of loading such as a marine shipping yard.

At point (D), the container is loaded on a ship operated by a carrier. At point (E), the container is shipped by the carrier to a port of discharge. At point (F), the container is discharged from the ship. Following discharge at point (F), the container is loaded onto a truck and gated out of the port of discharge at point (G). At point (H), the container is shipped via land to a desired location in a similar fashion to point (B). At point (I), upon arrival at the desired location, the container is unloaded by a consignee.

As will be apparent to those having ordinary skill in the art, there are many times within the points of the flow 2 at which security of the container could be compromised without visual or other conventional detection. In addition, the condition of the contents of the container could be completely unknown to any of the parties involved in the flow 2 until point (H) when the contents of the container are unloaded.

Figure 2A:
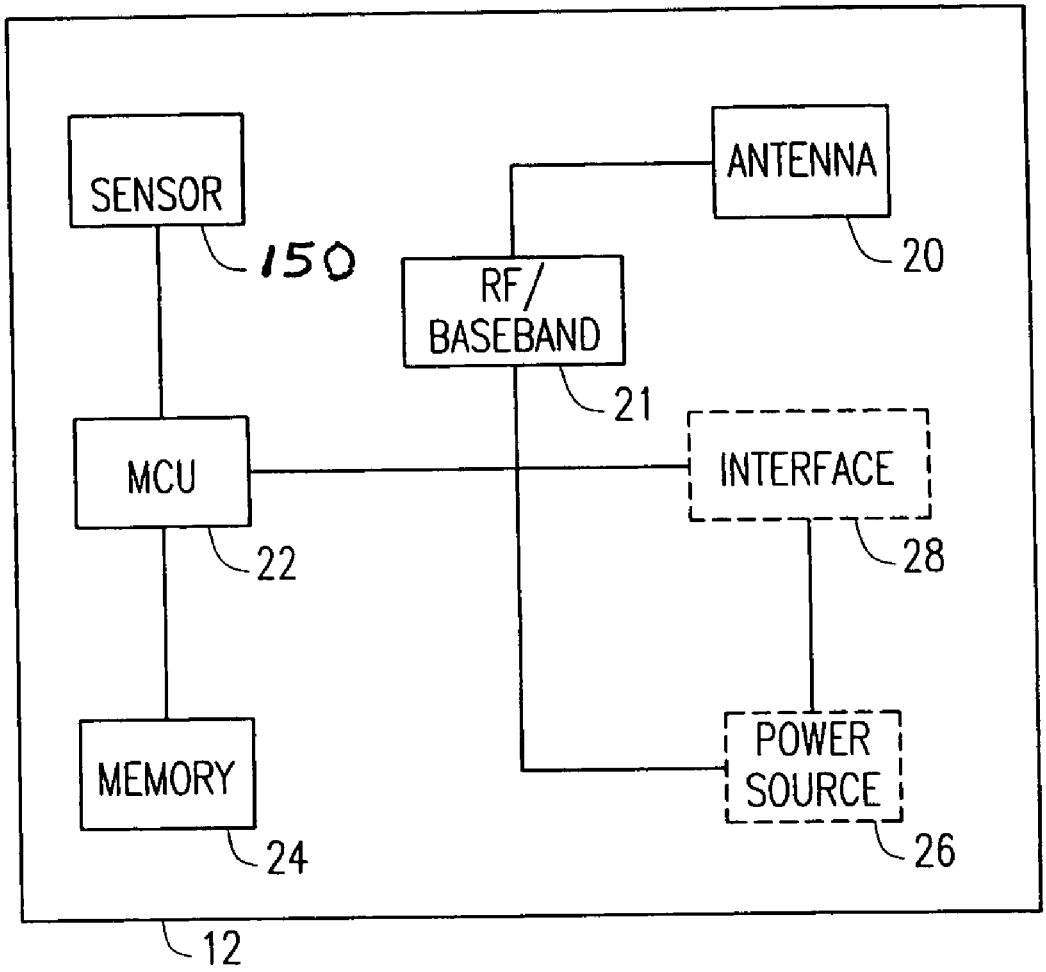
FIG. 2A is a schematic diagram of a device according to an embodiment of the present invention.

FIG. 2A is a block diagram of the device 12. The device 12 includes an antenna 20, an RF/baseband unit 21, a microprocessor (MCU) 22, a memory 24, and a sensor 150. The device 12 may also include an interface 28 for attachment of additional sensors to monitor various internal conditions of the container or its contents, such as, for example, temperature, vibration, radioactivity, gas detection, and motion. The device 12 may also include an optional power source 26 (e.g., battery); however, other power arrangements that are detachable or remotely located may also be utilized by the device 12. When the power source 26 includes a battery (as shown herein), inclusion of the power source 26 in the device 12 may help to prolong battery life by subjecting the power source 26 to smaller temperature fluctuations by virtue of the power source 26 being inside the container 10. The presence of the power source 26 within the container 10 is advantageous in that the ability to tamper with or damage the power source 26 is decreased. The device 12 may also optionally include a connector for interfacing directly with a reader 16. For example, a connector may be located on an outer wall of the container 10 for access by the reader 16. The reader 16 may then connect via a cable or other direct interface to download information from the device 12.

Still referring to FIG. 2A, optional sensors may be included in the manufacture of the device 12. Although not specifically shown in the block diagram of the device 12, optional sensors such as a light sensor or a temperature sensor may be directly assembled within the device 12. Relative to a light sensor, the aspect of a light pipe affording the device 12 with the capacity to directly detect the presence of changes in light relative thereto is described in more detail below. Likewise, the utilization of temperature readings may be deemed advantageous in certain applications, and may also be directly integrated within the device 12.

Still referring to FIG. 2A, the microprocessor 22 (equipped with an internal memory) discerns events from the sensor 150, including, for example, container-arming or disarming commands and container-security checks. The discerned door events also include security breaches that may compromise the contents of the container 10, such as opening of a door after the container 10 has been secured. The events may be time-stamped and stored in the memory 24 for transmission to the reader 16. The events may be transmitted immediately, periodically, or in response to an interrogation from the reader 16. The sensor 150 shown herein is of the proximity sensitive variety, although it may be, for example, any other suitable type of sensor detecting relative movement between two surfaces. The term sensor as used herein thus includes, but is not limited to, these other sensor varieties.

The antenna 20 is provided for data exchange with the reader 16. In particular, various information, such as, for example, status and control data, may be exchanged. The microprocessor 22 may be programmed with a code that uniquely identifies the container 10. The code may be, for example, an International Standards Organization (ISO) container identification code. The microprocessor 22 may also store other logistic data, such as Bill-of-Lading (B/L), a mechanical seal number, a reader identification with a time-stamp, etc. A special log file may be generated, so that arming and tracking history together with door and other sensor events may be recovered. The code may also be transmitted from the device 12 to the reader 16 for identification purposes. The RF/baseband unit 21 upconverts microprocessor signals from baseband to RF for transmission to the reader 16.

The device 12 may, via the antenna 20, receive an integrity inquiry from the reader 16. In response to the integrity query, the microprocessor 22 may then access the memory to extract, for example, door events, temperature readings, security breaches, or other stored information in order to forward the extracted information to the reader 16. The reader 16 may also send an arming or disarming command to the device 12.

When the container 10 is secured by the reader 16, the MCU 22 of the device 12 may be programmed to emit an audible or visual alarm when the sensor 150 detects certain movement and/or other events after the container is secured. The device 12 may also log the breach of security in the memory 24 for transmission to the reader 16. If the reader 16 sends a disarming command to the device 12, the microprocessor 22 may be programmed to disengage from logging door events or receiving signals from the sensor 150 or other sensors interoperably connected to the device 12.

The microprocessor 22 may also be programmed to implement power-management techniques for the power source 26 to avoid any unnecessary power consumption. In particular, one option is that one or more time window(s) are specified via the antenna 20 for activation of the components in the device 12 to exchange data. Outside the specified time windows, the device 12 may be set into a sleep mode to avoid unnecessary power consumption. Such a sleep mode may account for a significant part of the device operation time, the device 12 may as a result be operated over several years without a need for battery replacement.

In particular, according to the present invention, the device 12 utilizes a "sleep" mode to achieve economic usage of the power source 26. In the sleep mode, a portion of the circuitry of the device 12 is switched off. For example, all circuitry may be switched off except for the sensor 150 and a time measurement unit (e.g., a counter in the microprocessor 22) that measures a sleep time period $t_{sleep}$. In a typical embodiment, when the sleep time period has expired or when the sensor 150 senses a door event, the remaining circuitry of the device 12 is powered up.

When the device 12 receives a signal from the reader 16, the device 12 remains to communicate with the reader 16 as long as required. If the device 12 does not receive a signal from the reader 16, the device 12 will only stay active as long as necessary to ensure that no signal is present during a time period referred to as a radio-signal time period or sniff "period" ("$t_{sniff}$").

Upon $t_{sniff}$ being reached, the device 12 is powered down again, except for the time measurement unit and the sensor 150, which operate to wake the device 12 up again after either a door event has occurred or another sleep time period has expired.

In a typical embodiment, the reader-signal time period is much shorter (e.g., by several orders of magnitude less) than the sleep time period so that the lifetime of the device is prolonged accordingly (e.g., by several orders of magnitude) relative to an "always on" scenario.

The sum of the sleep time period and the reader-signal time period (cycle time") imposes a lower limit on the time that the device 12 and the reader 16 must reach in order to ensure that the reader 16 becomes aware of the presence of the device 12. The related time period will be referred to as the passing time ("$t_{pass}$").

However, a passing time ("$t_{pass}$") is usually dictated by the particular situation. The passing time may be very long in certain situations (e.g., many hours when the device 12 on a freight container is communicating with the reader 16 on a truck head or chassis carrying the container 10) or very short in other situations (e.g., fractions of a second when the device 12 on the container 10 is passing by the fixed reader 16(C) at high speed). It is typical for all the applications that each of the devices 12 will, during its lifetime, sometimes be in situations with a greater passing time and sometimes be in situations with a lesser passing time.

The sleep time period is therefore usually selected such that the sleep time period is compatible with a shortest conceivable passing time, ("$t_{pass,min}$"). In other words, the relation—

$$t_{sleep} \leq t_{pass,min} - t_{sniff}$$

should be fulfilled according to each operative condition of the device. Sleep time periods are assigned to the device in a dynamic matter depending on the particular situation of the device (e.g., within its life cycle).

Whenever the reader 16 communicates with the device 12, the reader 16 reprograms the sleep time period of the device 12 considering the location and function of the reader 16, data read from the device 12, or other information that is available in the reader 16.

For example, if the container 10 equipped with device 12 is located on a truck by a toplifter, straddle carrier, or other suitable vehicle, the suitable. vehicle is equipped with the reader 16, whereas the truck and trailer are not equipped with any readers 16. It is expected that the truck will drive at a relatively-high speed past the fixed reader 16(C) at an exit of a port or a container depot. Therefore, the reader 16(C) on the vehicle needs to program the device 12 with a short sleep time period (e.g., ~0.5 seconds).

Further ramifications of the ideas outlined above could be that, depending on the situation, the reader 16 may program sequences of sleep periods into the device 12. For example, when the container 10 is loaded onboard a ship, it may be sufficient for the device 12 to wake up only once an hour while the ship is on sea. However, once the ship is expected to approach a destination port, a shorter sleep period might be required to ensure that the reader 16 on a crane unloading the container 10 will be able to establish contact with the device 12. The reader 16 on the crane loading the container 10 onboard the ship could program the device 12 as follows: first, wake up once an hour for three days, then wake up every ten seconds.

In another scenario, the reader 16 is moving together with the device 12 and could modify the sleep time period in dependence on the geographical location. For example, it may be assumed that the device 12 on the container 10 and the reader 16 of a truck towing the container 10 may constantly communicate with each other while the container 10 is being towed. As long as the container 10 is far enough away from its destination, the reader 16 could program the device 12 to be asleep for extended intervals (e.g., one hour.) When the reader 16 is equipped with a Global Positioning System (GPS) receiver or other positioning equipment, the reader may determine when the container 10 is approaching its destination. Once the container approaches the destination, the reader 16 could program the device 12 to wake up more frequently (e.g., every second).

While the above-described power-management method has been explained with respect to the device 12 in the context of trucking of freight containers or other cargo in transportation by sea, road, rail or air, it should be understood for those skilled in the art that the above-described power-management method may as well be applied to, for example, trucking of animals, identification of vehicles for road toll collection, and theft protection, as well as stock management and supply chain management.

Figure 2B:
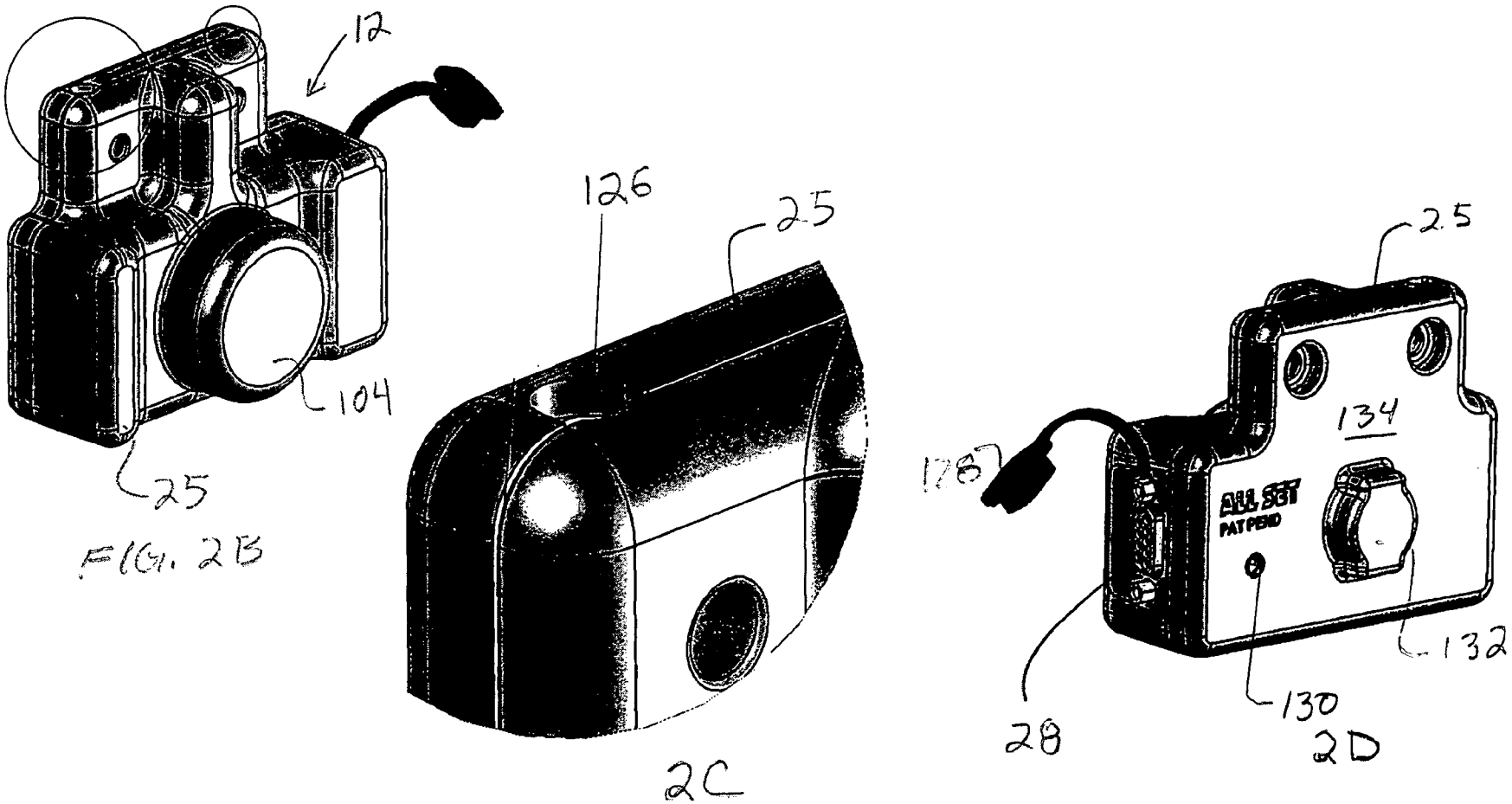
FIG. 2B is a first perspective view of a device according to an embodiment of the present invention.

Referring now to FIG. 2B, there is shown a first perspective view of the device 12. The device 12 includes a sensor housing 25 containing the data unit 100 (not shown) and an antenna area 104 extending outwardly thereof. The configuration of the housing 25 is particularly adapted for mounting within a container 10 that has been constructed or modified in the manner described in more detail below. The housing of FIG. 2B is presented for purposes of reference for the following description of various embodiments of the present invention.

Referring now to FIG. 2C, the particular embodiment of the housing 25, as shown herein, includes a filling hole 126 for receiving potting material such as clear polyurethane therein, to secure and protect all of the electronics and components contained within the housing 25. Clear polyurethane also facilitates the use of an integrated light sensor. The position of the filling hole 126 may of course vary, as may the actual shape of the housing 25. It should be noted that the potting of the components in the housing 25 is for purposes of protection from the harsh intermodal transport environment which can include a wide variation in temperature and humidity, salt water, fog, etc.

Referring now to FIG. 2D, there is shown a perspective view of the housing 25 from the opposite side to that shown in FIG. 2B. The housing 25 as illustrated in FIG. 2D, shows the interface 28 in the form of a D-Sub connector. A D-Sub connector cap 128 is likewise shown connected to the housing 25 for protection of the D-Sub connector when it is not in use. The D-Sub connector comprising interface 28 permits connection to other sensors within the container. These sensors may include vault sensors, radars, sonic and vibration sensors, smoke sensors and water sensors. Water sensors permit detection of water cutting devices that may be used in cutting steel. This is an important consideration as systems are upgraded to detect the integrity of all six sides of conventional containers.

Still referring to FIG. 2D, there is shown the end of a light pipe 130, which will be described in more detail below. A sensor housing portion 132 is shown extending outwardly of face 134 in a position for sensing select movement in accordance with the principles of the present invention. The positioning of the housing 25, as well as the orientation of the sensor area 132 will be shown and described in more detail below.

Figures 2E, 2F, 2G, 2H, 2J:
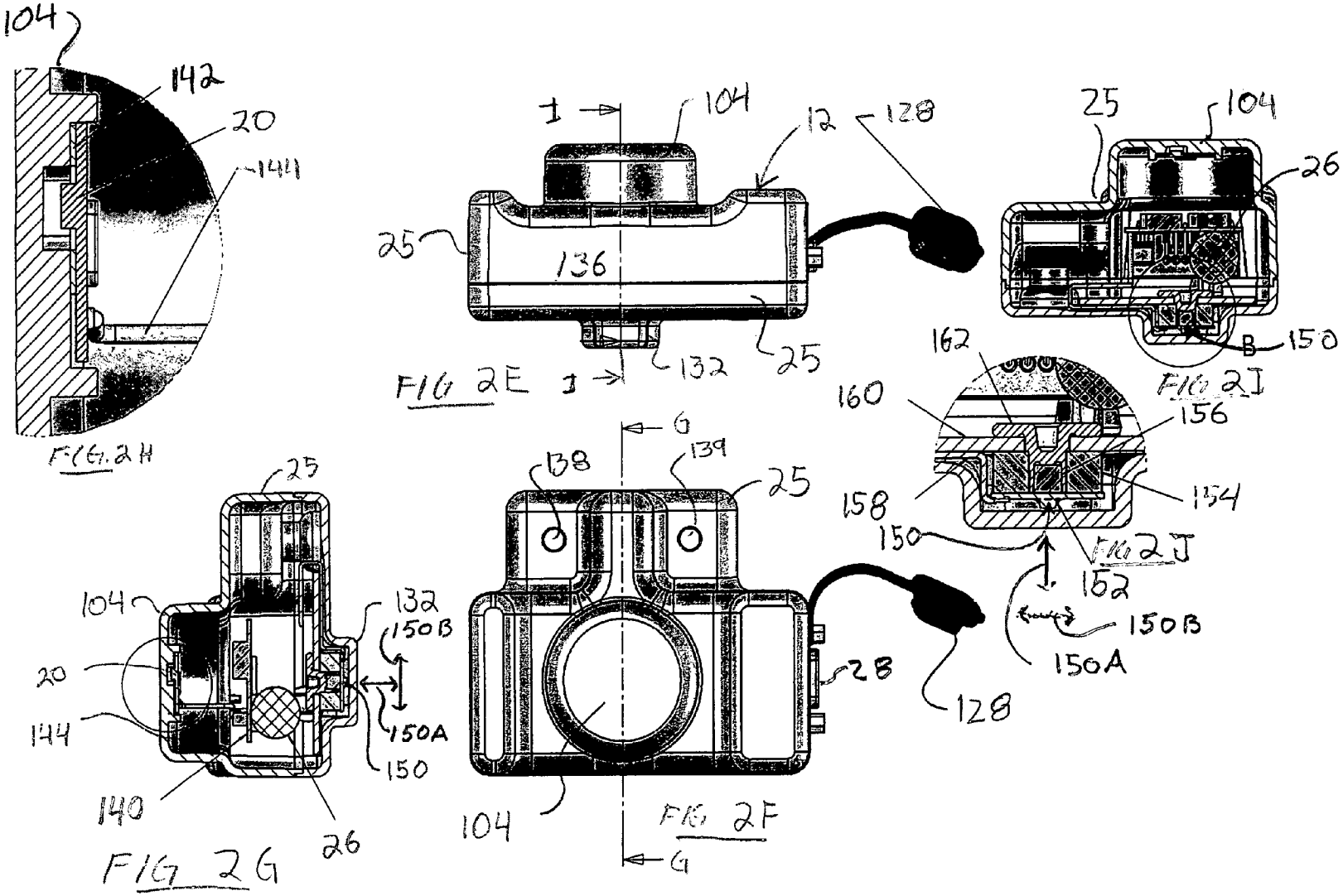
FIG. 2E is a bottom plan view of the device of FIG. 2B.
FIG. 2F is a front elevational view of the device of FIG. 2B.
FIG. 2G is a side elevational cross-sectional view of the device of FIG. 2F taken through lines G-G thereof.
FIG. 2H is an enlarged side-elevational cross-sectional view of the designated portion of FIG. 2G.
FIG. 2J is an enlarged, side elevational cross-sectional view of the region of FIG. 21 designated therein.

Referring now to FIG. 2E, there is shown the housing 25 in a bottom plan view. Antenna area 104 and sensor area 132 are shown extending outwardly from a central body region 136. The central body region 136 of the present embodiment is generally rectangular in shape. The shape, size and relative proportions of the antenna area 104, sensor area 132 and body region 136 may, of course, vary in accordance with the principles of the present invention.

Referring now to FIG. 2F, there is shown a front elevational view of the housing 25 illustrating the extension of the D-Sub cap outwardly therefrom. A pair of mounting apertures 138 and 139 is likewise shown, which apertures are adapted for receiving threaded fasteners therein for the mounting of the housing 25, as will be described in more detail below.

Referring now to FIG. 2G, there is shown a side elevational, cross-sectional view of the housing 25 illustrating the assembly thereof. Housing 25 includes the battery 26 being disposed therein adjacent a printed circuit board main card 140, as will be described in more detail below. Outwardly of card 140 is the antenna area 104, in which is mounted the antenna 20.

Referring now to FIG. 2H, the mounting of antenna 20 within the antenna area 104 of the housing 25 is enlarged and more clearly shown. Antenna 20 is shown to be mounted in the antenna area 104 by adhesive tape 142. An antenna cable 144 is shown extending rearwardly from the antenna 20 to the card 140.

Referring back now to FIG. 2G, the side of the housing 25 opposite the antenna 20 is the sensor area 132. In the present invention, a Hall effect sensor 150 is mounted therein, having a sensor axis 150A, as described in more detail below. It should be noted, however, that the utilization of a Hall effect sensor is shown for purposes of illustration only in that other types of sensors may be utilized in accordance with the principles of the present invention. The reference to a Hall effect sensor, as described herein, is for purposes of describing an embodiment of the invention and is not meant to be limiting in any respect relative to the spirit and scope of the present invention. For example, there are varieties of proximity sensors used in industry today to detect the proximity of an object relative to another using different technologies, as further referenced herein.

Referring now to FIG. 2I, there is shown a side elevational cross-sectional view of the housing 25 of the present invention taken from the opposite side of the housing 25 to that shown in FIG. 2G. In the present illustration, the battery 26 is likewise shown disposed between antenna area 104 and the sensor 150.

Referring now to FIG. 2J, an enlarged view of the sensor 150 of FIG. 2I is shown. The sensor 150 in this particular embodiment, is shown to be comprised of a Hall effect sensor card 152, a ring magnet 154, an ferrous core 156, a sensor cable 158, a steel sheet 160, and a plastic positioning part 162. The ferrous core 156 is preferably manufactured of a consistent material from a magnetic point of view. The importance of this aspect is due to the fact that there are many variations in the type of steel that will be used in a container, particularly container doors. Material will vary from container to container, so there is a distinct advantage in having a consistency in the ferrous core 156 to provide consistency and sensitivity of the sensor 150. It should be noted that the iron core described above in conjunction with the ring magnet 154 provides a flux pattern which is appreciably strong, allowing for even higher degrees of flux pattern linearity, sensitivity and reliability. This particular assembly will therein accommodate not only the material variations from container to container, referenced above, but also the racking of the container described above. As recited, intermodal transport containers are often stacked one atop another in such a manner as to impart twisting stresses thereto. A container which twists under the load of containers thereabove and/or the motion of the vessel carrying the container during shipment, will manifest movement that must be adequately discerned by the sensor 150. In the present embodiment, the sensor 150 detects variations in the flux pattern as a result of relative movement between the doors of the container one from the other. Relative movement between the doors due to racking, which is manifest mainly in a vertical movement for which any horizontal displacement between the vertically-aligned doors is minor, should not be detected with such an assembly. In this manner, only movement of the doors indicative of a breach of the integrity of the container is detected to maximize the effectiveness and reliability of the present invention.

Figure 3:
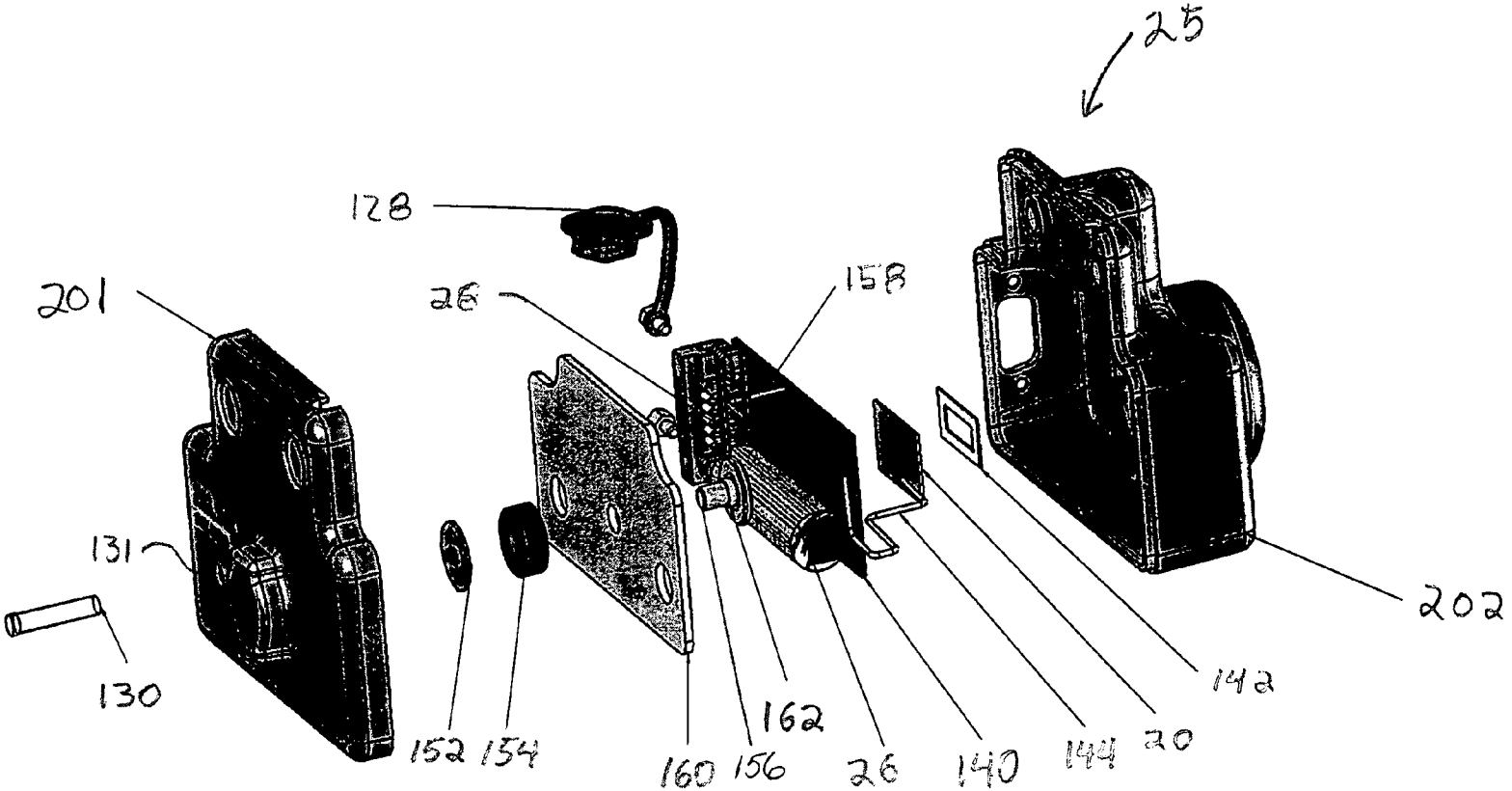
FIG. 3 is an exploded, assembly view of the device of FIG. 2B.

Referring now to FIG. 3, there is shown an exploded assembly view of the device of FIG. 2B wherein the housing 25 is shown to be constructed of two housing sections. In this particular embodiment, the housing 25 may be constructed of plastic and a first plastic casing back side 201 is shown facing a plastic casing door side 202.

Still referring to FIG. 3, the opposite halves of the housing 25, 201 and 202, respectively, may, in one embodiment, be joined together by friction-welding, or the like, together before the potting operation described above. The potting operation will secure the various components therein including the antenna 20 which is secured by the antenna tape 142 adjacent the card 140. The antenna 20 is connected to the card 140 by the antenna cable 144. The battery 26 is mounted on the opposite side of the card 140 from the antenna 20, and the plastic positioning part 162 and ferrous core 156 is shown assembled relative to the steel sheet 160 and ring magnet 154. The Hall effect sensor card is likewise presented in alignment with the ring magnet 154. The light pipe 130 is shown positioned outwardly of the casing backside 201 for positioning through aperture 131 formed in the face thereof. The light pipe 130 is preferably made of transparent plastic material wherein light is able to reach down to a light sensor (such as surface mounted, not shown) at the card 140. In this way, the presence of light within the container, indicative of a breach of integrity, may be detected in accordance with the principles of the present invention.

Figure 4:
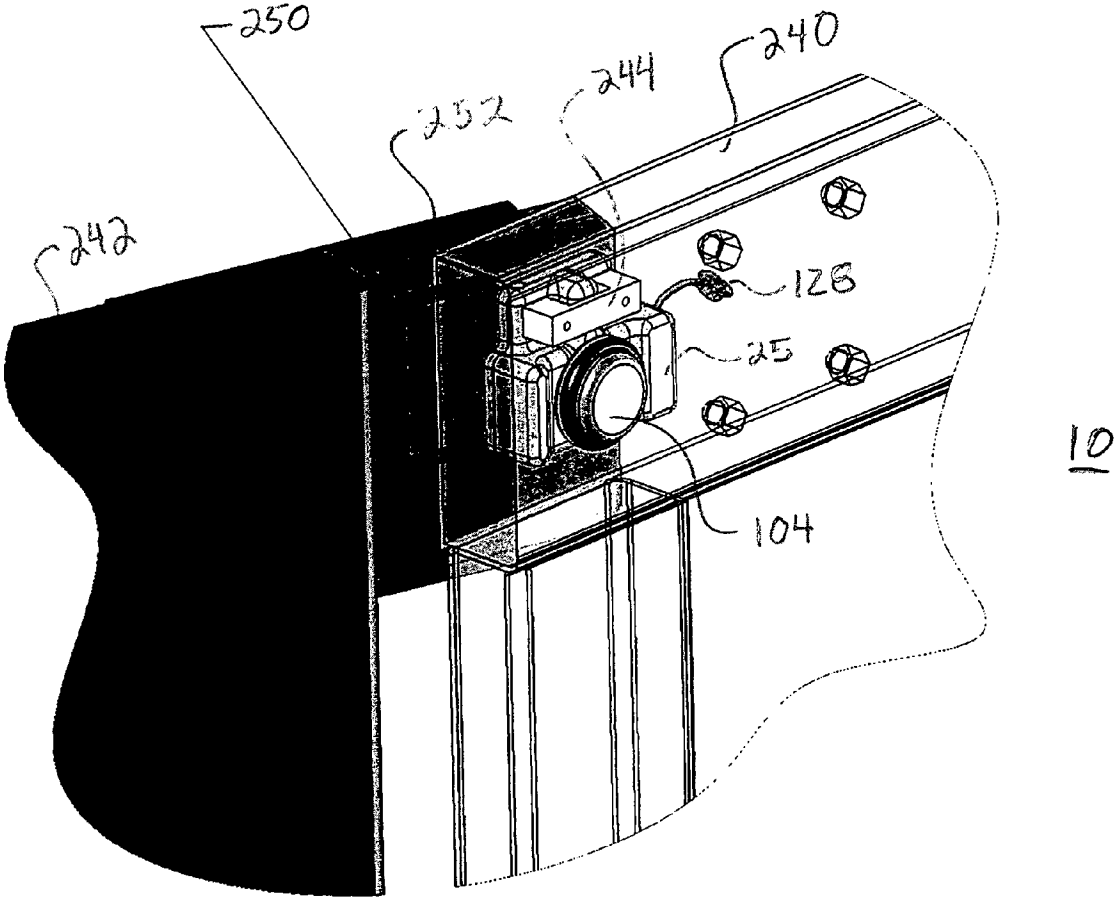
FIG. 4 is a perspective view of the device of FIG. 2B shown mounted in a container in accordance with one embodiment of the principles of the present invention.

Referring now to FIG. 4, there is shown a fragmentary perspective view of a container 10 comprising right door 240 and left door 242. The housing 25 is shown mounted in right door 240, along an upper portion thereof. The door 240 is shown diagrammatically to provide a transparent view of the housing 25 mounted therein. Mounting of the housing 25 with the antenna area 104 extending outwardly thereof is made possible by mounting member 244. The mounting member 244 is constructed in a generally U-shape configuration with threaded apertures formed therein in the present embodiment. In this manner, threaded fasteners may be extended through the apertures 138 and 139 of the housing 25, shown in FIG. 2F for purposes of securely mounting the housing 25 in the container 10. A flange 250, comprising an upstanding run or barrier is welded to a keeper plate 252 extending outwardly from door 242.

The flange 250 is provided to protect the housing 25 from tampering attempts with inserted objects or the like. It should further be noted that the particular mounting of the housing 25 in the door 240 of FIG. 4 is but one embodiment of a mounting technique in accordance with the principles of the present invention. This particular mounting technique does, however, facilitate the use of the Hall effect sensor referenced above for determining any relative movement between doors 240 and 242, or other metal surfaces such as the door frame.

Figure 5:
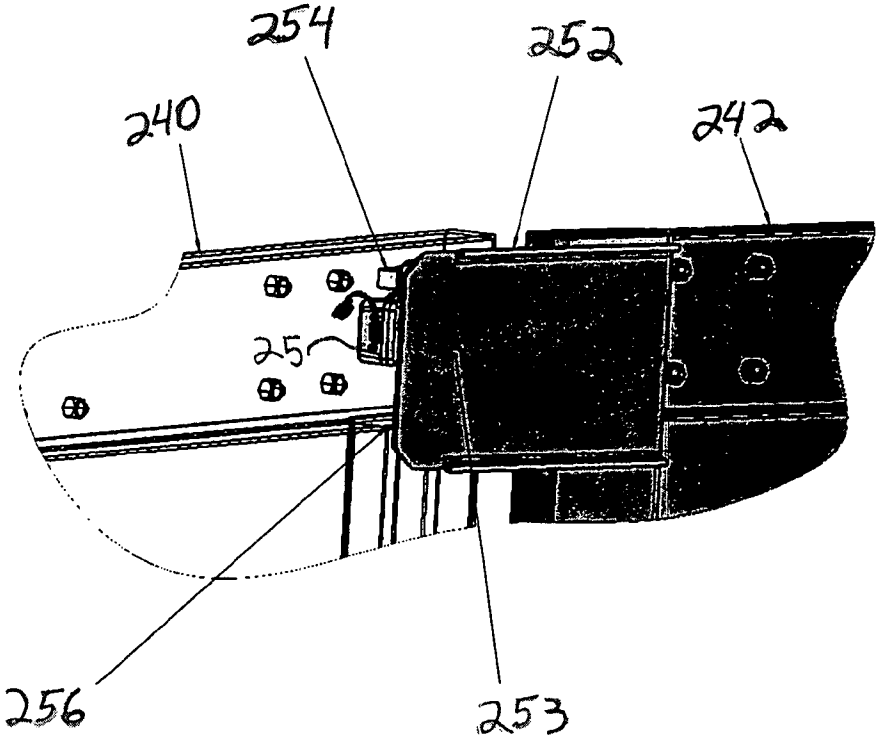
FIG. 5 is a rear perspective view of the container region illustrating the mounting of the device of FIG. 2B and a keeper plate disposed oppositely the sensor.

Referring now to FIG. 5, there is shown a rear perspective view of the doors 240 and 242 of FIG. 4. In this particular view, the keeper plate 252 is shown extending outwardly from the rear side of door 242 in position to cover the housing 25. The presence of the keeper plate 252 also provides a surface for interaction with the Hall effect sensor 150 described above. In that regard, the keeper plate 252 bears against the inside of the right door 240 as viewed from outside the container. The length of the keeper plate 252 is sufficiently long to permit it to function as a lever, making it impossible to open both doors at the same time or the left door first, without creating a detectable movement of increasing distance between the keeper plate 252 and the Hall effect sensor.

Referring now to FIGS. 6A-6D, there are shown four views illustrating the principles of the present invention. FIG. 6A illustrates a front elevational view of the mounting of the housing 25 in the door 240 of container 10. An aperture 230 is constructed in the door 240 in the position shown to provide for the exposure of the antenna area 104 of the housing 25 for purposes of antenna communication to a location outside of the container 10.

FIG. 6B is a side elevational cross-sectional view of the door 240 of FIG. 6A taken along lines B-B thereof and illustrating the housing 25 securely mounted therein. It may be seen that the location of the housing 25 is in the web area of a structural beam wherein the aperture 230 may be formed without deleterious structural implications for the container 10. In that regard, the aperture 230 accommodates the antenna area 104 of the housing 25 and is further fitted with an elastomeric gasket 260 for securement therearound in a manner providing sealing thereto.

Referring now to FIG. 6C, there is shown the antenna 20 disposed outwardly in the antenna area 104 for communication with a location outside of the container 10 in accordance with the principles of the present invention.

Referring now to FIG. 6D, there is shown a bottom plan, cross-sectional view of the container door 240 of FIG. 6A along lines D-D thereof. In this view, the housing 25 is shown securely mounted by the U-shaped mounting member 244.

In operation, the embodiments of the invention described above permit detection of relative horizontal or opening movement between the doors of the freight container 10. As described above, it should also be noted that the Hall effect sensor 150 is but one type of sensor for use in accordance with the principles of the present invention. For example, another analog magnetic flux vector (magnitude and direction) sensor may be incorporated. Likewise, a Reed switch and a balanced system of one internal magnet and a second magnet located in the door frame is contemplated. As shown and described above, the Hall effect sensor measures the magnetic vector field changes when there is separation between the sensor and the sensed object, such as occurs when the doors on the container are moving away from each other. This is made possible by the fact that a magnetic vector field sensor can directly detect a magnetic field, its magnitude and direction from a permanent magnet. The measured magnetic field or flux varies relative to the distance of the ferrous material, and thus the manner of mounting the Hall effect sensor 150 as described herein relative to the keeper plate 252 as above described, affords a highly reliable method of proximity measurement.

The Hall effect sensor of the present invention utilizes a ring magnet, the flux pattern of which is strong, allowing for even higher degrees of flux pattern linearity, sensitivity and reliability. In this manner, the sensor detects the combined magnetic fields from both the object and the magnet. Therein, variations in the flux patterns as a result of relative movement of separation between the doors of the container one from the other as described above result in changes in electrical current, voltage or resistance, and thus the generation of a signal indicative of movement. This separation movement occurs along a sensor axis 150A, shown in FIGS. 2J and 2G. The sensor of the present invention discriminates between movement along the sensor axis 150A and movement generally orthogonal thereto as indicated by arrow 150B Relative movement in the direction of arrow 150B may occur by normal container racking, or the like, and such movement generally does not indicate a breach. For this reason, the sensor 150 is designed to detect movement along axis 150A. It may also be appreciated that very small movement at the hinge of the doors of the container 10 is magnified at the region of the intersection of the two doors as shown herein. In this manner, the sensor of the present invention is able to detect quite small openings of the door, and thus affords a higher degree of reliability and container integrity monitoring than may otherwise be possible. It should also be recognized that by using a ring magnet, in combination with an ferrous core 156 (FIG. 3), an extra high and more linear flux is provided through the sensors so as to increase the dynamic range of the sensor to the benefit of the system, as well as better tolerances in assembling the sensor device in production.

Although the above embodiment is shown as a single unit including at least one sensor and an antenna 20 for communicating with the reader 16, the present invention may be implemented as several units. For example, a light, temperature, radioactivity, etc. sensor may be positioned anywhere inside the container 10. The sensor takes readings and transmits the readings via BLUETOOTH, or any short range communication system, to an antenna unit that relays the readings or other information to the reader 16. The sensors may be remote and separate from the antenna unit. In addition, the above embodiment illustrates a device 12 that includes a sensor 150 for determining whether a security breach has occurred. However, an unlimited variety of sensors may be employed to determine a security breach in place of, or in addition to, the sensor 150. For example, the light pipe 130 described above may sense fluctuations in light inside the container 10. If the light exceeds a predetermined threshold, then it is determined a security warning may be reported indicating that a possible breach has occurred. A temperature sensor, radioactivity sensor, combustible gas sensor, etc. may be utilized in a similar fashion.

The device 12 may also trigger the physical locking of the container 10. For instance, when a reader 16 secures, via a security command, the contents of the container 10 for shipment, the microprocessor 22 may initiate locking of the container 10 by energizing elecromagnetic door locks or other such physical locking mechanism. Once the container is secured via the security command, the container 10 is physically locked to deter theft or tampering.

As referenced above, the device 12 may also be coupled to a plurality of other sensors disposed within the container 10. The device 12 may then be utilized to receive from the sensors conditions necessitating warning and/or alarm. For example, a radioactivity sensor may be utilized to generate an alarm signal relative to the detected presence of radioactive materials placed in the container 10. Similarly, one or more light sensors may be disposed within a container 10 for detecting the presence of light, which could indicate the physical penetration of a surface of the container to allow outside light therein, indicating a security breach. These and other sensors may be utilized in conjunction with device 12 in accordance with the principles of the present invention.

Also referenced above is the fact that future containers may be fabricated from non-ferrous material whereby the containers are RF transparent. In that eventuality, a variety of other types of sensors, in addition to those described herein, may be utilized in accordance with the principles of the present invention. Likewise, a container that is made of polycarbonate material may not require the use of an aperture for placement of an antenna in a position for transmission outwardly of the container. With the walls of the container being RF transparent, an aperture would generally not be necessary. Likewise, the sensor housing could be designed in a varied configuration, wherein the transmitter section is not sized and shaped for integration with such an aperture.

Figure 7A:
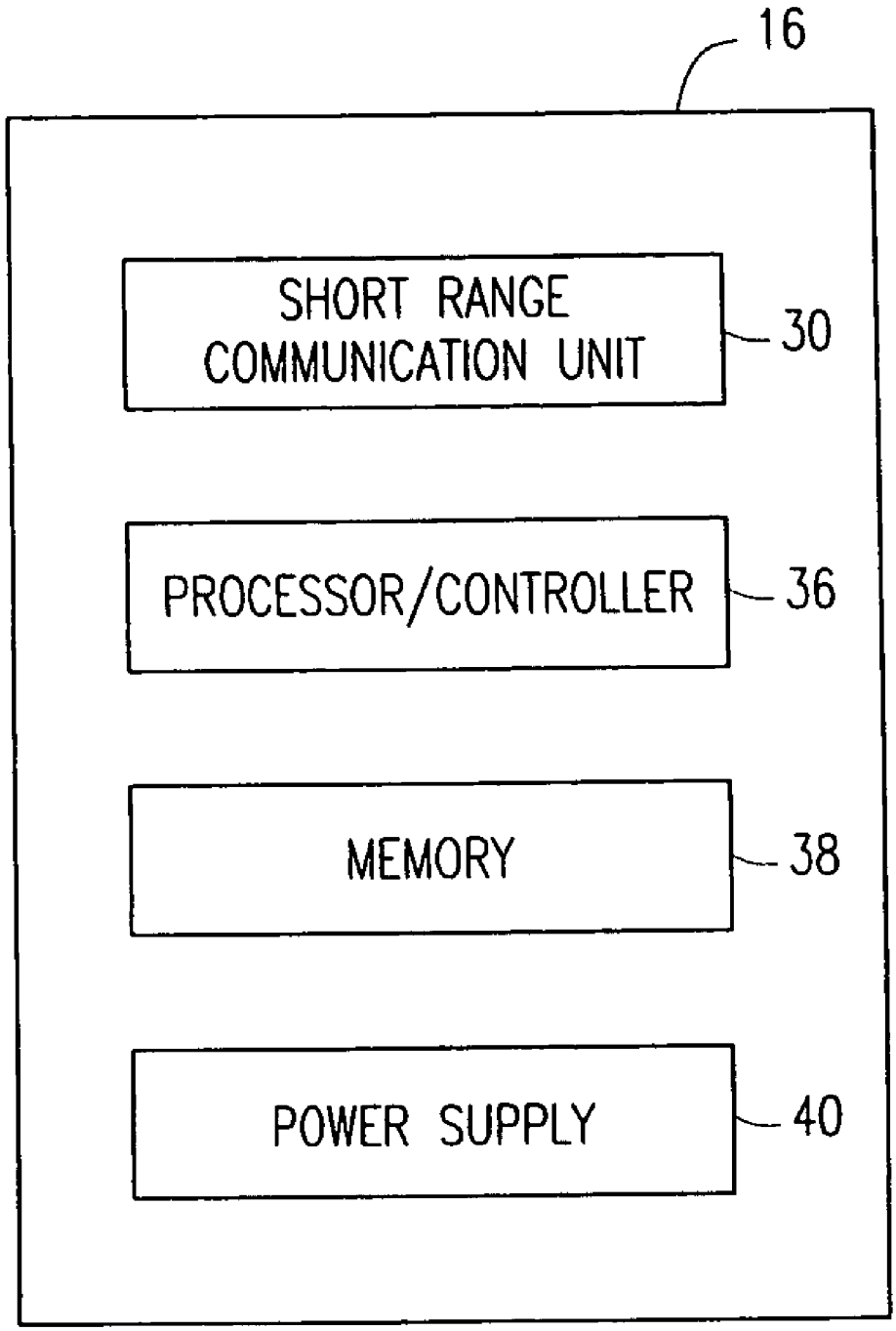
FIG. 7A is a schematic diagram of a reader according to an embodiment of the present invention.

As shown in FIG. 7A, the reader 16 includes a short range antenna 30, a microprocessor 36, a memory 38, and a power supply 40. The short range antenna 30 achieves the wireless short-range, low-power communication link to the device 12 as described above with reference to FIG. 2A. The reader 16 may include or separately attach to a device that achieves a link to a remote container-surveillance system (e.g., according to GSM, CDMA, PDC, or DAMPS wireless communication standard or using a wired LAN or a wireless local area network WLAN, Mobitex, GPRS, UMTS). Those skilled in the art will understand that any such standard is non-binding for the present invention and that additional available wireless communications standards may as well be applied to the long range wireless communications of the reader 16. Examples include satellite data communication standards like Inmarsat, Iridium, Project 21, Odyssey, Globalstar, ECCO, Ellipso, Tritium, Teledesic, Spaceway, Orbcom, Obsidian, ACeS, Thuraya, or Aries in cases where terrestrial mobile communication systems are not available.

The reader 16 may include or attach to a satellite positioning unit 34 is for positioning of a vehicle on which the container 10 is loaded. For example, the reader 16 may be the mobile reader 16(B) attached to a truck, ship, or railway car. The provision of the positioning unit 34 is optional and may be omitted in case tracking and positioning of the container 10 is not necessary. For instance, the location of the fixed reader 16(C) may be known; therefore, the satellite positioning information would not be needed. One approach to positioning could be the use of satellite positioning systems (e.g., GPS, GNSS, or GLONASS). Another approach could be the positioning of the reader 16 utilizing a mobile communication network. Here, some of the positioning techniques are purely mobile communication network based (e.g., EOTD) and others rely on a combination of satellite and mobile communication network based positioning techniques (e.g., Assisted GPS).

The microprocessor 36 and the memory 38 in the reader 16 allow for control of data exchanges between the reader 16 and the device 12 as well as a remote surveillance system as explained above and also for a storage of such exchanged data. Necessary power for the operation of the components of the reader 16 is provided through a power supply 40.

Figure 7B:
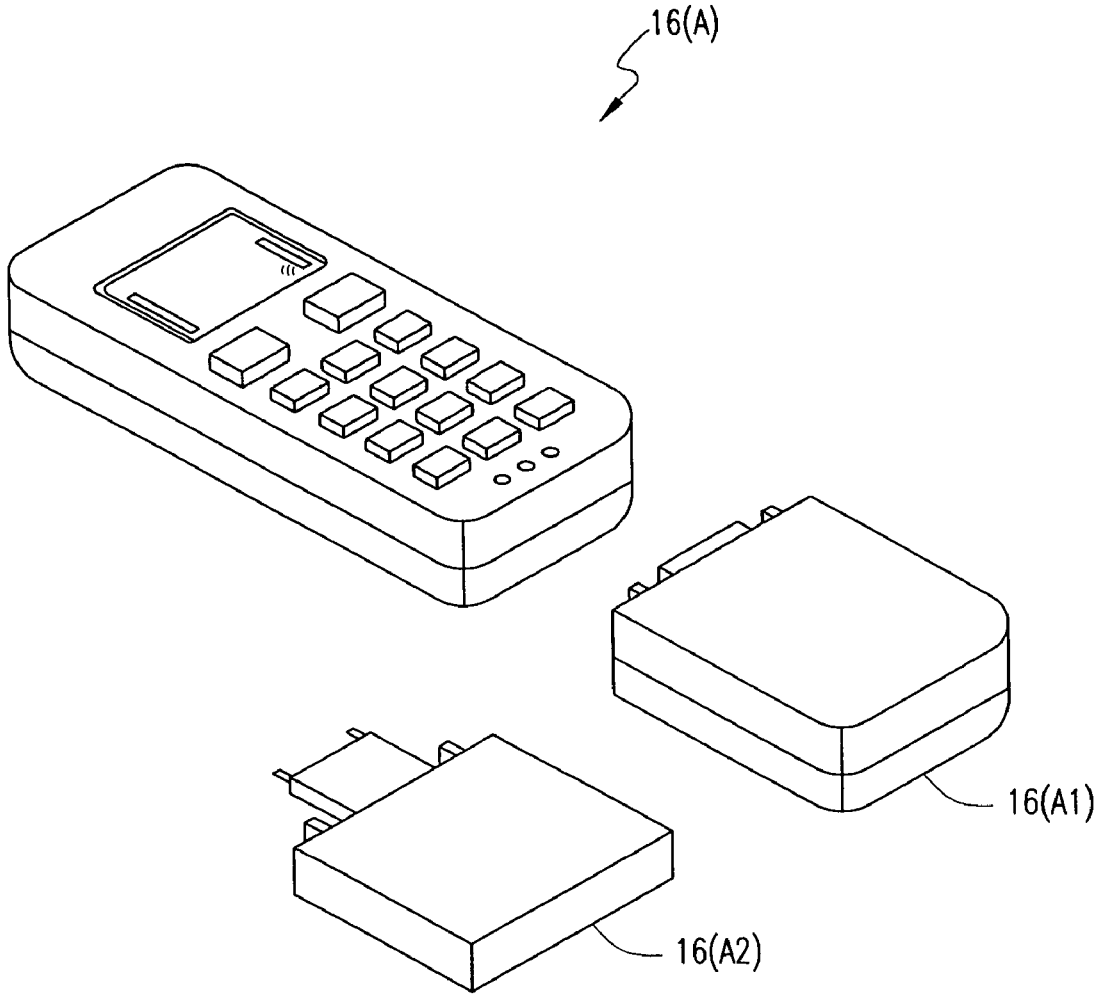
FIG. 7B is a diagram of a reader in accordance with the principles of the present invention.

FIG. 7B is a diagram of a handheld reader 16(A) in accordance with the principles of the present invention. The handheld reader 16(A) is shown detached from a mobile phone 16(A1). The handheld reader 16(A) communicates (as previously mentioned) with the device 12 via, for example, a short-range direct sequence spread spectrum radio interface. Once the handheld reader 16(A) and the device 12 are within close range of one another (e.g., <100 m), the device 12 and the handheld reader 16(A) may communicate with one another. The handheld reader 16(A) may be used to electronically secure or disarm the container via communication with the device 12. The handheld reader 16(A) may also be used to obtain additional information from the device 12 such as, for example, information from additional sensors inside the container 10 or readings from the sensor 150.

The handheld reader 16(A) shown in FIG. 7B is adapted to be interfaced with a mobile phone shown as 16(A1) or PDA. However, as will be appreciated by those having skill in the art, the handheld reader 16(A) may be a standalone unit or may also be adapted to be interfaced with, for example, a personal digital assistant or a handheld or laptop computer. The reader 16 draws power from the mobile phone and utilizes Bluetooth, or any similar interface, to communicate with the mobile phone.

Additional application scenarios for the application of the device 12 and reader 16 will now be described. Insofar as the attachment and detachment of the reader 16(B) to different transporting or transported units is referred to, any resolvable attachment is well covered by the present invention (e.g., magnetic fixing, mechanic fixing by screws, rails, hooks, balls, welding, snap-on mountings, further any kind of electrically achievable attachment, e.g., electro magnets, or further reversible chemical fixtures such as adhesive tape, scotch tape, glue, pasted tape).

Figure 8:
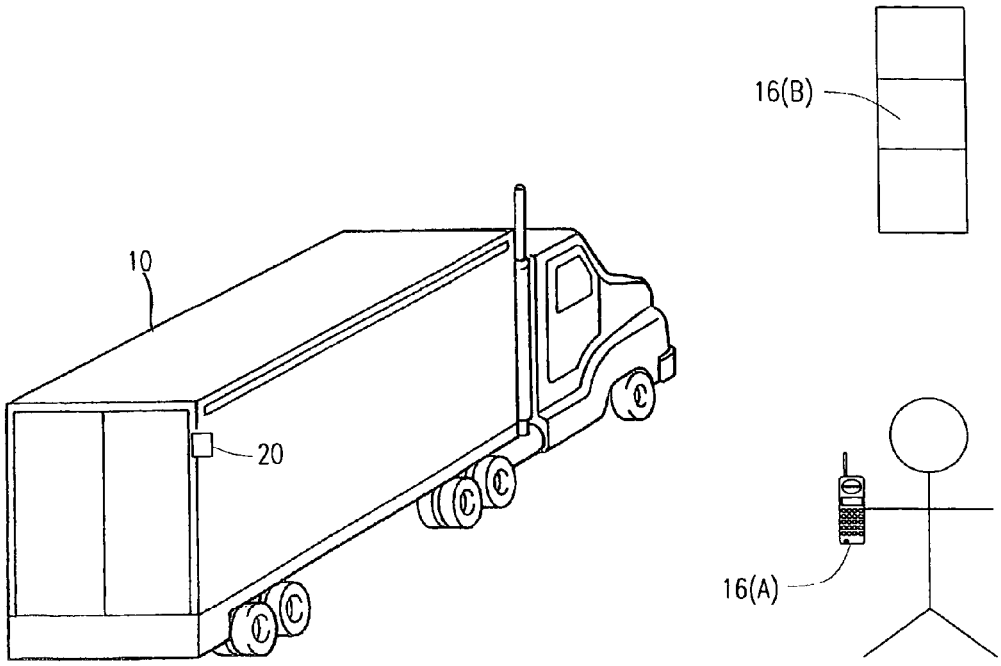
FIG. 8 is a first application scenario of the system of FIG. 1A according to an embodiment of the present invention.

FIG. 8 shows a first application scenario of the device 12 and the reader 16. As shown in FIG. 8 one option related to road transportation is to fix the reader 16 to the gate or a shipping warehouse or anywhere along the supply chain. In such a case, the reader 16 may easily communicate with the device 12 of the container 10 when being towed by the truck when exiting the shipping area. Another option is to provide the reader 16 as a handheld reader 16(A) as described above and then either scan the device 12 as the truck leaves the area or carry the hand-held reader 16(A) within the cabin of the truck during surveillance of the container 10.

Figure 9:
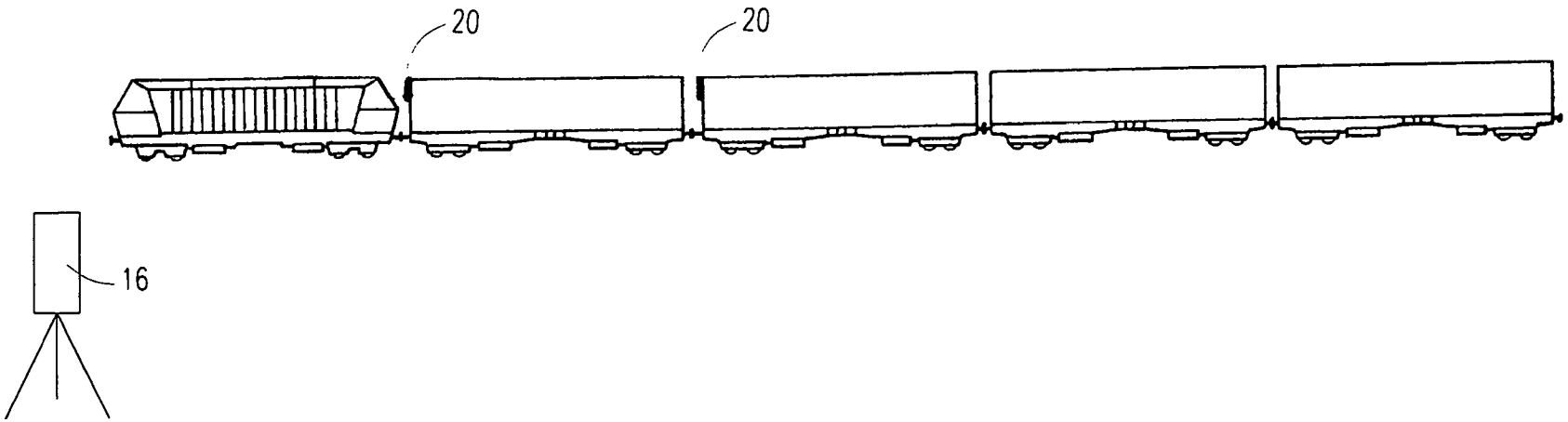
FIG. 9 is a second application scenario of the system of FIG. 1A according to an embodiment of the present invention.

FIG. 9 shows a second application scenario for the device 12 and the reader 16 as related to rail transportation. In particular, FIG. 9 shows a first example where the reader 16 is attachably fixed along the rail line for short-range wireless communication to those containers located in the reach of the reader 16. The reader 16 may then achieve a short range communication with any or all of the devices 12 of the containers 10 that are transported on the rail line.

Figure 10:
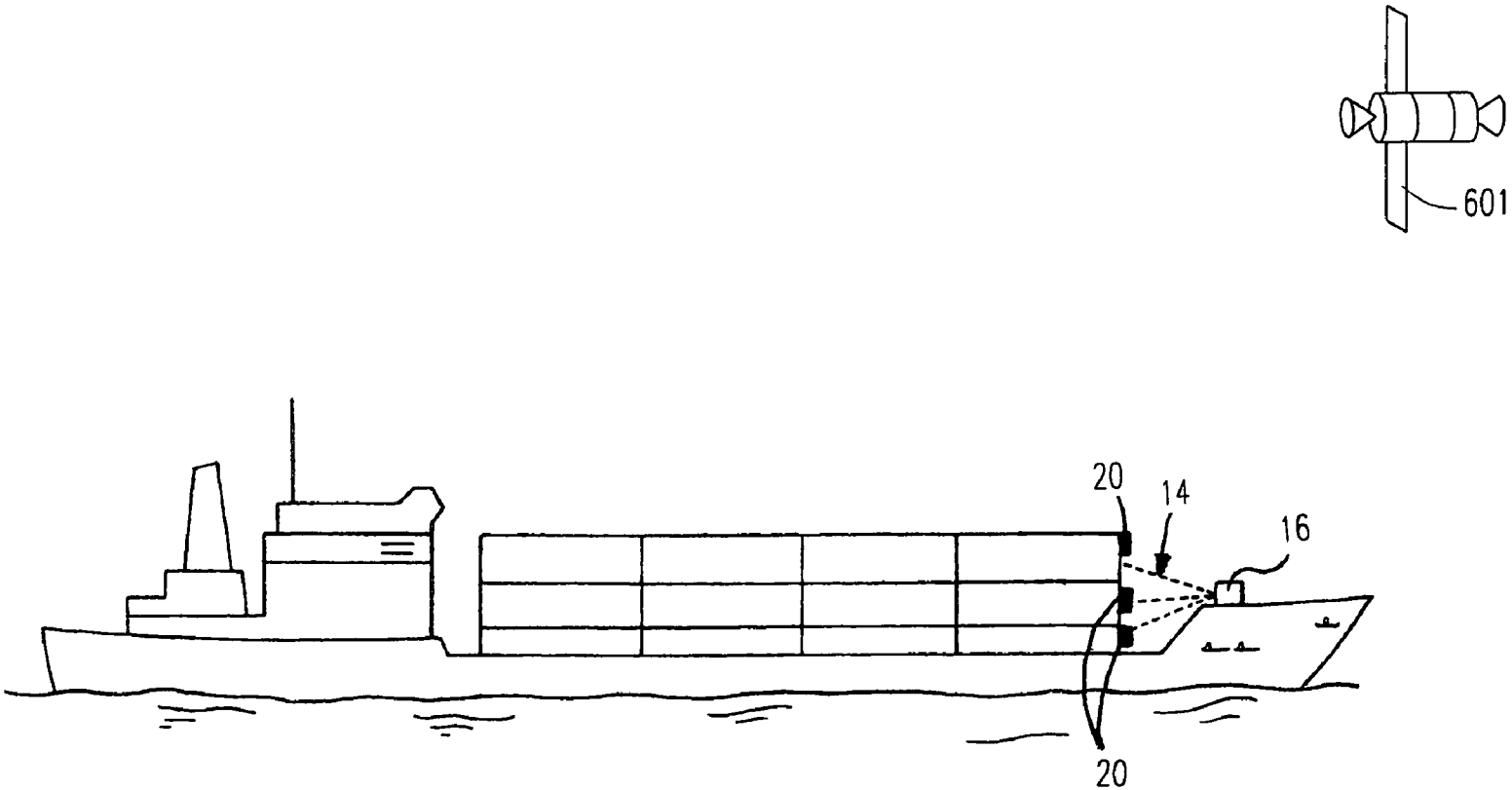
FIG. 10 is a third application scenario of the system of FIG. 1A according to an embodiment of the present invention.
Figure 11:
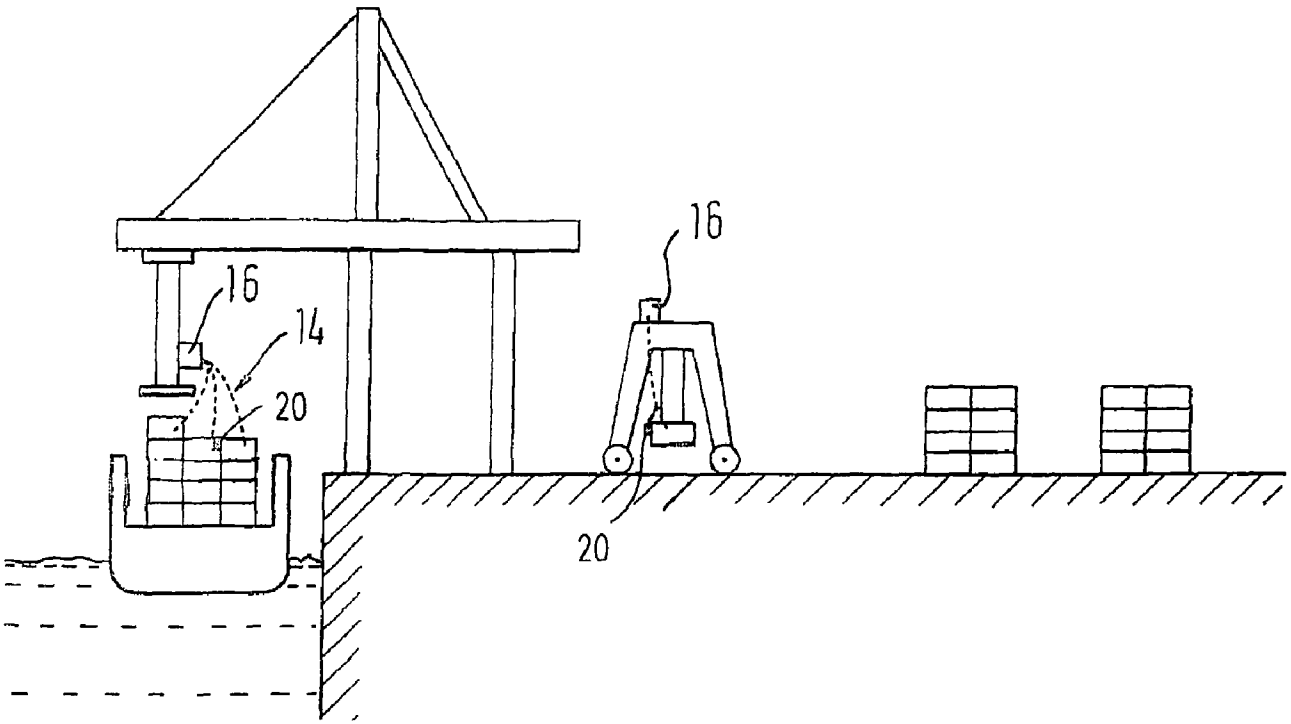
FIG. 11 is a fourth application scenario of the system of FIG. 1A according to an embodiment of the present invention.

The same principles apply to a third application scenario for the container surveillance components, as shown in FIG. 10. Here, for each container to be identified, tracked, or monitored during sea transport, there must be provided a reader 16 in reach of the device 12 attached to the container 10. A first option would be to modify the loading scheme according to the attachment schemes for the wireless communication units. Alternatively, the distribution of the readers 16 over the container ship could be determined in accordance with a loading scheme being determined according to other constraints and parameters. Again, the flexible attachment/detachment of readers 16 for the surveillance of containers allows to avoid any fixed assets that would not generate revenues for the operator. In other words, once no more surveillance of containers is necessary, the reader 16 may easily be detached from the container ship and either be used on a different container ship or any other transporting device. The reader 16 may also be connected to the AIS, based on VHF communication, or Inmarsat satellites, both often used by shipping vessels.

While above the application of the inventive surveillance components has been described with respect to long range global, regional or local transportation, in the following the application within a restricted area will be explained with respect to FIG. 7.

In particular, the splitting of the short range and long range wireless communication within a restricted area is applied to all vehicles and devices 12 handling the container 10 within the restricted area such as a container terminal, a container port, or a manufacturing site in any way. The restricted area includes in-gates and out-gates of such terminals and any kind of handling vehicles such as top-loaders, side-loaders, reach stackers, transtainers, hustlers, cranes, straddle carriers, etc.

A specific container is not typically searched for using only a single reader 16; rather, a plurality of readers 16 spread over the terminal and receive status and control information each time a container 10 is handled by, for example, a crane or a stacker. In other words, when a container passes a reader 16, the event is used to update related status and control information.

Figure 12:
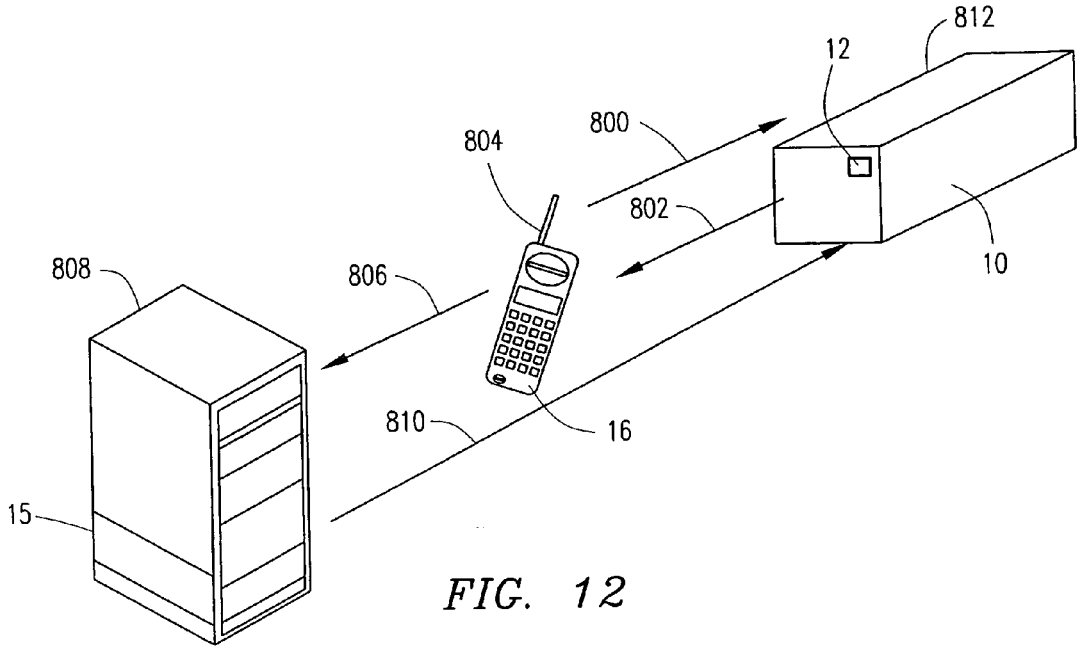
FIG. 12 is a diagram illustrating a container-securing process.

FIG. 12 illustrates a flow diagram of a securing process, as set forth in the above-referenced U.S. patent application Ser. No. 10/667,282. First, at step 800, identification is requested from the device 12 by the reader 16. At step 802, the device 12 transmits the identification to the reader 16 and, at step 804, the reader 16 selects a container 10 to secure. A request is sent from the reader 16 to the server 15 at step 806. At step 808, the server 15 generates a security key and encrypts the security key with an encryption code. At step 810, the encrypted security key is transmitted to the device 12 via the reader 16 in order to secure the container 10. At step 812, the security key is decrypted and stored in the device 12. A similar procedure may be initiated to disarm the container 10. The container 10 may be secured automatically when passing in range of a reader 16, or a user may secure or disarm specific chosen containers 10 at a time.

Figure 13:
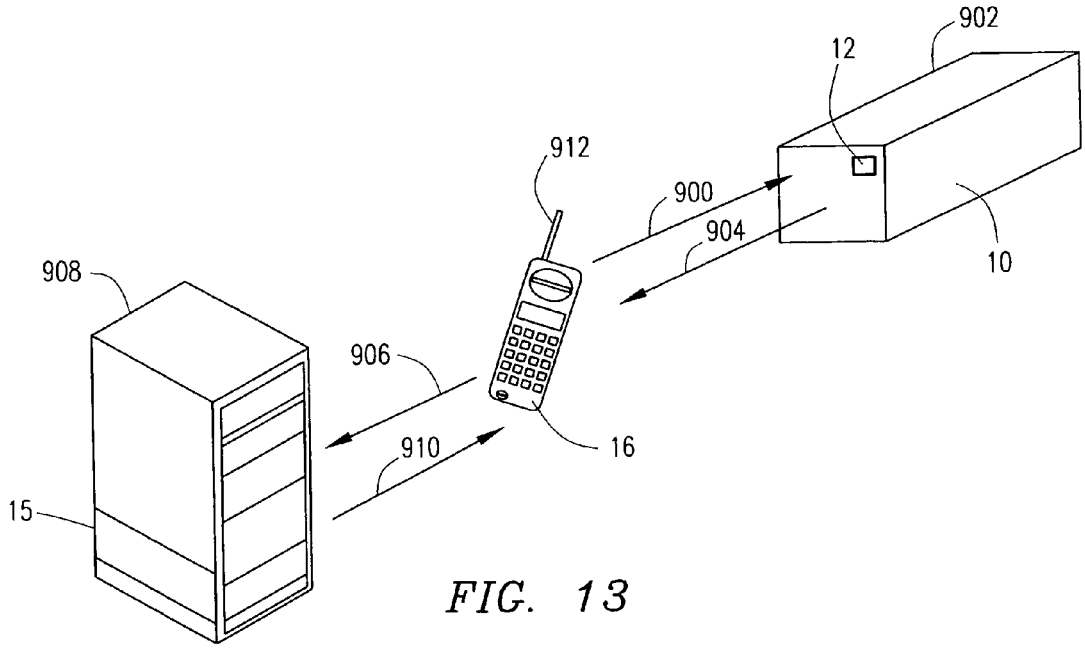
FIG. 13 is a diagram illustrating a container-security-check process.

FIG. 13 illustrates a security-check process. At step 900, the reader 16 transmits a challenge to the container 10 in question. At step 902, the device 12 of the container 10 generates a response using a security key and an encryption code. At step 904, the response is sent from the device 12 to the reader 16. At step 906, the reader 16 also sends a challenge to the server 15. The challenges to the server 15 and the device 12 may be transmitted substantially simultaneously or at alternate points in time. The server 15 generates and sends a response utilizing the security key and an encryption code to the reader 16 at steps 908 and 910 respectively. At step 912, the reader 16 determines if the responses are equal. If the responses are equal, then the container 10 remains safely secured. Alternatively, if the responses are not equal, then a security breach (i.e., door event) of the container 10 has occurred. Similarly to the arming and disarming processes, a security-check may be performed automatically as the container 10 passes in range of a reader 16 or a user may initiate a security-check at any time during transport.

It should be noted that the original architecture of the system utilized an encryption technique that essentially required network access to fully validate a proper security status check of a CSD. The same key was used to validate that the CSD was still armed and not in an alarm state. In another embodiment, a PKI (public key infrastructure) is used. A public and a private key is therein used to validate the CSD and its status. This function is performed without reference to whether or not a network connection is available. This approach of symmetric versus asymmetric encryption is well known in the art and is presented herein for reference purposes.

Although embodiment(s) of the present invention have been illustrated in the accompanying Drawings and described in the foregoing Detailed Description, it will be understood that the present invention is not limited to the embodiment(s) disclosed, but is capable of numerous rearrangements, modifications, and substitutions without departing from the invention defined by the following claims.

What is claimed is:

1. A sensor system for monitoring security of a container, the system comprising:

a sensor secured to a first door of a container;

a plate attached to a second door of the container, wherein the sensor is configured to measure a distance between the sensor and the plate, and wherein the plate extends away from a hinge of the second door and is configured to restrict a movement of the second door when the first door and second door are in a closed position;

a processor configured to process data received from the sensor to determine whether an opening of at least one of the first door and the second door has occurred;

a power source configured to power the processor; and a memory configured to store a determination of the processor.

2. A sensor system as in claim 1, further comprising:

a transmitter configured to wirelessly transmit data stored in the memory to a receiving device located outside of the container.

3. A sensor system as in claim 1, wherein the processor is configured to make the determination based upon a change in the distance between the sensor and the plate.

4. A sensor system as in claim 1, wherein the data received from the sensor is analog data.

5. A sensor system as in claim 4, wherein the sensor is a Hall effect sensor.

6. A sensor system as in claim 5, wherein the Hall effect sensor comprises:

a ring magnet;

a ferrous ring displaced co-axially within the ring magnet; and a Hall effect sensor card positioned co-axially adjacent to the ferrous ring.

7. A sensor system as in claim 1, wherein the plate comprises a metal.

8. A sensor system as in claim 1, wherein the sensor is configured to be inserted in an aperture formed in the first door of the container.

9. A sensor system as in claim 1, wherein the container is a shipping container.

10. A sensor system as in claim 1, wherein the sensor is insensitive to movement of the plate in a plane orthogonal to a sensor axis.

11. A method of monitoring security of a container, the container having a first door and second door, each movable between a closed position and an open position, the method comprising:

closing the first door of the container, the first door having a sensor secured thereto and positioned to define a sensor axis;

closing the second door of the container, the second door having a plate attached thereto and positioned along the sensor axis, wherein the plate extends away from a hinge of the first door to restrict movement of the second door when the first door and the second doors are in the closed position;

wherein the sensor is configured to measure a distance between the sensor and the plate;

receiving data output from the sensor; and processing the data output of the sensor to determine whether an opening of at least one of the first door and the second door has occurred.

12. A method as in claim 11, wherein the data received from the sensor is analog data.

13. A method as in claim 11, further comprising:

storing the determination of the processing in a memory of the sensor.

14. A method as in claim 11, wherein the sensor is insensitive to movement of the plate in a plane orthogonal to the sensor axis.

15. A method as in claim 11, wherein the sensor is a Hall effect sensor.

16. A method as in claim 15, wherein the Hall effect sensor comprises:

a ring magnet;

a ferrous ring displaced co-axially within the ring magnet; and a Hall effect sensor card positioned co-axially adjacent to the ferrous ring.

17. A method as in claim 11, wherein the plate comprises a metal.

18. A method as in claim 11, wherein the sensor is configured to be inserted in an aperture formed in the first door of the container.

19. A shipping container, comprising:

an enclosure for storing an item, the enclosure having a first door and a second door for accessing an interior of the enclosure;

a plate attached to the second door, the plate configured to restrict a movement of the second door when the first door and the second door are in a closed position;

a sensor assembly secured to the first door and positioned to measure a distance between the plate and the sensor, the sensor assembly configured to output data indicative of the measured distance between the plate and the sensor;

a processor configured to receive and process the output data to determine whether an opening of at least one of the doors has occurred; and a memory for storing the determination of the processor.

20. A shipping container as in claim 19, wherein the sensor is insensitive to movement of the plate in a plane orthogonal to a sensor axis.

21. A shipping container as in claim 19, wherein the sensor is a Hall effect sensor.

22. A shipping container as in claim 21, wherein the Hall effect sensor comprises:

a ring magnet;

a ferrous ring displaced co-axially within the ring magnet; and a Hall effect sensor card positioned co-axially adjacent to the ferrous ring.

23. A shipping container as in claim 19, wherein the plate comprises a metal.

24. A shipping container as in claim 19, wherein the sensor is configured to be inserted in an aperture formed in the first door of the container.

* * * * *